US010322305B2

(12) United States Patent
Balquist et al.

(10) Patent No.: US 10,322,305 B2
(45) **Date of Patent: *Jun. 18, 2019**

(54) RETRACTING LIFELINE SYSTEMS FOR USE IN TIE-BACK ANCHORING

(71) Applicant: Honeywell International Inc., Morris Plains, NJ (US)

(72) Inventors: Ross Balquist, Slippery Rock, PA (US); Eric M. Manson, Franklin, PA (US); Steve J. Sharp, Pleasantville, PA (US); Hugh Smith, Franklin, PA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/882,530

(22) Filed: Jan. 29, 2018

(65) Prior Publication Data

US 2018/0147428 A1 May 31, 2018

Related U.S. Application Data

(63) Continuation of application No. 13/080,731, filed on Apr. 6, 2011, now Pat. No. 9,913,999.

(60) Provisional application No. 61/321,491, filed on Apr. 6, 2010.

(51) Int. Cl.
*A62B 35/04* (2006.01)
*A62B 35/00* (2006.01)

(52) U.S. Cl.
CPC ..... *A62B 35/0093* (2013.01); *A62B 35/04* (2013.01)

(58) Field of Classification Search
CPC ..... A62B 35/0093; A62B 35/04
See application file for complete search history.

(56) References Cited

U.S. PATENT DOCUMENTS

| | | | | |
|---|---|---|---|---|
| 4,640,384 | A * | 2/1987 | Kucher | B66B 9/00 182/142 |
| 4,714,135 | A | 12/1987 | Bell et al. | |
| 4,928,790 | A | 5/1990 | Franks | |
| 5,400,868 | A | 3/1995 | Ellis et al. | |
| 5,704,669 | A | 1/1998 | Clark | |
| 5,771,993 | A | 6/1998 | Anderson et al. | |
| 6,006,860 | A * | 12/1999 | Bell | A62B 35/04 182/18 |
| 7,237,650 | B2 | 7/2007 | Casebolt | |
| 7,946,387 | B2 | 5/2011 | Betcher et al. | |

(Continued)

*Primary Examiner* — Alvin C Chin-Shue
(74) *Attorney, Agent, or Firm* — Alston & Bird LLP

(57) ABSTRACT

A retracting lifeline system, includes: a housing, a first connector attached to the housing, a lifeline, and a hub to which the lifeline is attached at a first end of the lifeline and around which the lifeline is coiled within the housing. The housing includes an opening through which the lifeline exits the housing. The hub is tensioned to rotate in a first direction to cause retracting of the lifeline and coiling of the lifeline around the hub. The retracting lifeline system further includes a second connector attached to a second end of the lifeline. At least a section of the lifeline has an initial ultimate tensile load of at least 8000 pounds and is abrasion resistant (that is, satisfying the abrasion test requirement set forth in the ANSI/ASSE Z359.13 2009 standard) such that the section of the lifeline is available for tie-back anchoring using the second connector. The section of the lifeline is at least partially retractable within the housing.

16 Claims, 20 Drawing Sheets

(56) References Cited

U.S. PATENT DOCUMENTS

| | | | | |
|---|---|---|---|---|
| 8,186,023 | B2 | 5/2012 | Millar et al. | |
| 2003/0188495 | A1 | 10/2003 | Taylor et al. | |
| 2004/0250387 | A1* | 12/2004 | Jones | A44B 1/42 24/633 |
| 2005/0145435 | A1 | 7/2005 | Choate | |
| 2006/0102423 | A1* | 5/2006 | Lang | A62B 35/0012 182/36 |
| 2007/0215410 | A1 | 9/2007 | Ecker | |
| 2008/0230313 | A1* | 9/2008 | Botti | A62B 1/16 182/70 |
| 2009/0032785 | A1* | 2/2009 | Jones | A62B 1/08 254/274 |
| 2009/0084631 | A1 | 4/2009 | Casebolt | |
| 2009/0211847 | A1 | 8/2009 | Balquist et al. | |
| 2009/0211848 | A1 | 8/2009 | Balquist et al. | |
| 2009/0211849 | A1 | 8/2009 | Balquist et al. | |
| 2010/0224448 | A1 | 9/2010 | Wolner et al. | |
| 2016/0298365 | A1* | 10/2016 | Christensen | E05B 75/00 |

* cited by examiner

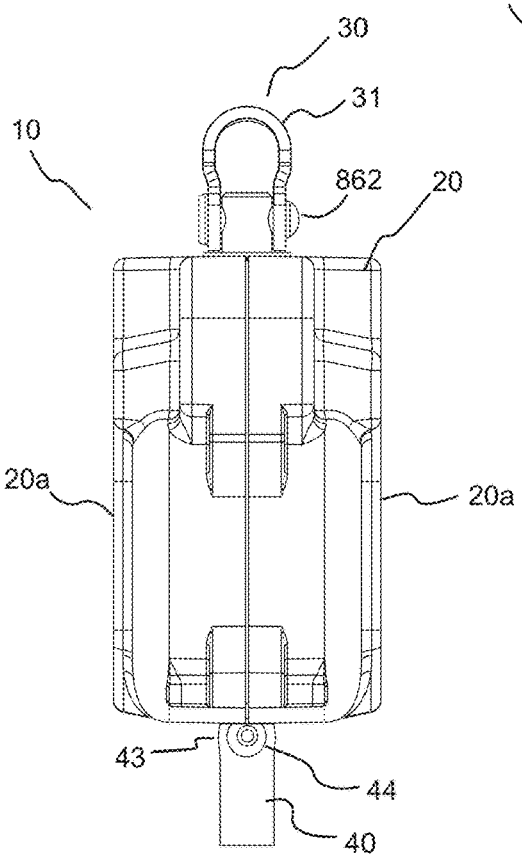
Figure 1A
Figure 1B
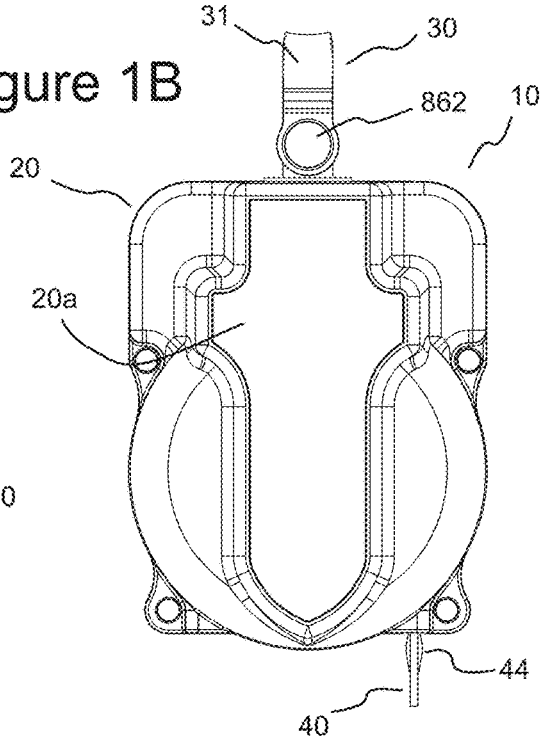
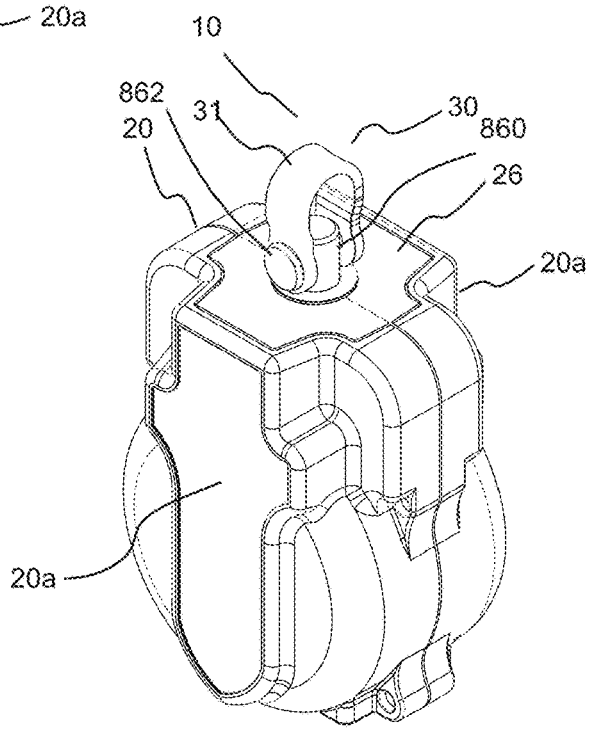
Figure 1C

RETRACTING LIFELINE SYSTEMS FOR USE IN TIE-BACK ANCHORING

CROSS-REFERENCE TO RELATED APPLICATIONS

This application is a continuation of, and claims the benefit of the filing date of U.S. Provisional Ser. No. 61/321,491, filed Apr. 6, 2010, and U.S. Ser. No. 13/080,731, filed Apr. 6, 2011, which are hereby incorporated by reference in their entirety.

BACKGROUND

The following information is provided to assist the reader to understand the devices, systems and methods disclosed below and the environment in which they will typically be used. The terms used herein are not intended to be limited to any particular narrow interpretation unless clearly stated otherwise in this document. References set forth herein may facilitate understanding of the devices, systems and method or the background thereof. The disclosures of all references cited herein are incorporated by reference.

Many devices have been developed in an attempt to prevent or minimize injury to a worker falling from a substantial height. For example, a number of devices (known alternatively as self-retracting or retracting lifelines, retracting lanyards, fall arrest blocks, etc.) have been developed that limit a worker's free fall distance to a specified distance and limit fall arresting forces to a specified value.

In general, most currently available retracting lifeline safety devices or systems include a number of common components. Typically, a housing or cover provides enclosure/protection for the internally housed components. The housing includes attached thereto a connector for anchoring the retracting lifeline to either the user or to a fixed anchor point. The connector must be capable of withstanding forces required to stop a falling body of a given mass in a given distance. Components of retracting lifeline system such as the lifeline and connectors can, for example, have an ultimate tensile load or minimum breaking strength of at least 4500 pounds.

A drum or spool around which a lifeline is coiled or spooled rotates within the housing. The drum is typically under adequate rotational tension to reel up excess extended lifeline without hindering the mobility of the user. Like the anchor connector and the other operative components of the retractable lifeline safety device, the drum is formed to withstand forces necessary to stop a falling body of a given mass in a given distance. The lanyard or lifeline is attached at one end thereof to the drum to allow the drum to reel in excess lifeline. The lifeline is attached at the other end thereof to either the user or to an anchorage point, whichever is not already attached to the housing.

Retracting lifeline systems also include a mechanism which locks (that is, prevents rotation of) the drum assembly of the retracting lifeline upon indication that a fall is occurring. For example, when the rope, cable or web being pulled from the retracting lifeline system causes the drum assembly to rotate above a certain angular velocity or experience an angular acceleration above a certain level, a brake mechanism can cause the drum assembly to suddenly lock.

Given the forces experienced by retracting lifeline systems upon sudden locking of drum rotation, the operational components of retracting lifeline system are typically manufactured from high-strength materials such as stainless steel to ensure locking, while withstanding the stresses associated therewith. In that regard, though the fall may be stopped upon actuation of the braking mechanism of a retracting lifeline system, the suddenness of the stop may cause injury to the user or produce higher than desirable stresses in one more components of the safety system. Energy or shock absorbing devices or systems are typically used to absorb energy experienced by the retracting lifeline system and the user.

In a tie-back application, a lifeline of a retracting lifeline system is wrapped around an acceptable anchorage structure and is connected back onto itself (via an end connector), creating a secure anchorage for the user. In currently available retracting lifeline systems, a substantial length of a strengthened or reinforced portion of the lifeline over which tie-back is permitted is maintained outside of the housing. For example, a sleeve of a durable and/or sacrificial material can be used to encase a length of lifeline extending from the housing to enable tie-back over the length of the sleeve. The thickness and stiffness of the sleeve and/or a stitched portion in the webbing prevents the sleeve from being drawn within the housing. Although it is safe to tie back over the length of the sleeved or reinforced portion of the lifeline, there is no guarantee that a user will not tie back up-line from that portion of the lifeline over which it is safe to tie back. Moreover, the substantial length of lifeline maintained outside of the housing (for example, 36 inches or more) creates a catching, snagging and/or tripping hazard. Further, the substantial length of lifeline maintained outside of the housing can result in an undesirable length of free fall in the case that a significant portion of the length outside the housing is unused in tie back to an anchor (for example, in the case of tie back to an anchor having a relatively small circumference).

SUMMARY

In one aspect, a retracting lifeline system, includes: a housing, a first connector attached to the housing, a lifeline, and a hub to which the lifeline is attached at a first end of the lifeline and around which the lifeline is coiled within the housing. The housing includes an opening through which the lifeline exits the housing. The hub is tensioned to rotate in a first direction to cause retracting of the lifeline and coiling of the lifeline around the hub. The retracting lifeline system further includes a second connector attached to a second end of the lifeline. At least a section of the lifeline has an initial ultimate tensile load of at least 8000 pounds and is abrasion resistant such that the section of the lifeline is available for tie-back anchoring using the second connector. The section of the lifeline is at least partially retractable within the housing. As used herein, the phrase "abrasion resistant" refers to a line or lifeline that satisfies the abrasion test requirement set forth in the ANSI/ASSE Z359.13 2009 standard.

The section of the lifeline can, for example, have an initial ultimate tensile load of at least 9,000 pounds, at least 10,000 pounds or at least 12,000 pounds.

The entire length of the lifeline that is extendible from the housing (or the entire length of the lifeline) can, for example, have an initial ultimate tensile load of at least 8,000 pounds, at least 9,000 pounds, at least 10,000 pounds or at least 12,000 pounds and be abrasion resistant (that is, satisfying the abrasion test requirement set forth in the ANSI/ASSE Z359.13 2009 standard) such that the entire length of the lifeline that is extendible from the housing is available for tie-back anchoring.

In a number of embodiments, the lifeline can, for example, be formed as a continuous length of woven webbing. The webbing can, for example, have a thickness less than 0.1 inches and a width of not greater than 1.25 inches. No protective sleeve or reinforced section is required to enable tie back on the webbing.

The retractable lifeline system can, for example, further include an energy absorbing system positioned at least partially within the housing. The energy absorbing system includes a first retaining member and a second retaining member. The first retaining member can, for example, be connected to a connector extending from the housing so that the connector is rotatable relative to the first retaining member. The connector extending form the housing can be connected to the first connector such that the first connector is rotatable relative to the housing. The second retaining member is operatively connected to the hub. The first retaining member is connected to the second retaining member by at least one energy absorbing member that increases in effective length upon activation thereof so that the distance between the first retaining member and the second retaining member increases upon activation of the energy absorbing system.

The energy absorbing member can, for example, include at least a first length of material connected to a second length of material via tear elements which tear to absorb energy upon activation of the energy absorbing system.

The retractable lifeline system can, for example, further include at least one breakable connector connecting the first retaining member to the second retaining member. The breakable connector breaks or disconnects upon experiencing a first load such that first retaining member separates from the second retaining member by an observable distance to provide an observable indication that the first load has been experienced.

The energy absorbing member can, for example, be activated upon or after breaking of the breakable connector. As used herein, the terms "break", "breakable" and like terms as used in connection with the breakable connector indicated that the connection formed by the breakable connector disconnects upon the first load such that first retaining member separates from the second retaining member.

Upon activation, the energy absorbing member can, for example, absorb energy to maintain a load experienced by the lifeline during activation of the energy absorbing member no greater than a predetermined magnitude.

The retractable lifeline system can further include an abutment member or a stop connected to the lifeline. In a number of embodiments, the stop includes at least a first member extending from at least a first surface of the lifeline to abut the opening upon retraction of the lifeline and prevent further retraction of the lifeline. The distance the first member extends from the first surface can, for example, vary to increase from a perimeter of the first member to an inward portion of the first member.

The stop can further include at least a second member extending from at least a second surface of the lifeline to abut the opening upon retraction and prevent further retraction of the lifeline. The distance the second member extends from the second surface can, for example, vary to increase from a perimeter of the second member to an inward portion of the second member. The first member can, for example, be connected to the second member by a connecting member passing through the lifeline. The lifeline can, for example, include or be formed as webbing. In a number of embodiments, the first member has a generally frusto-conical shape and the second member has a generally frusto-conical shape. The connecting member can, for example, include a rivet. The distance the first member extends from the first surface can, for example, be at a minimum at the perimeter of the first member, and the distance the second member extends from the second surface can, for example, be at a minimum at the perimeter of the second member. In a number of embodiments, the distance that each of the first member and the second member extends from the first and second surfaces, respectively, increases linearly from the perimeters thereof toward an inward portion thereof.

In another aspect, a retracting lifeline system includes a housing, a first connector attached to the housing, a lifeline, and a hub to which the lifeline is attached at a first end of the lifeline and around which the lifeline is coiled within the housing. The housing includes an opening through which the lifeline exits the housing. The hub is tensioned to rotate in a first direction to cause retracting of the lifeline and coiling of the lifeline around the hub. The retracting lifeline system further includes an energy absorbing system positioned at least partially within the housing. The energy absorbing system includes a first retaining member and a second retaining member. The first retaining is connected to a connector extending from the housing so that the connector is rotatable relative to the first retaining member. The connector extending form the housing can be connected to the first connector such that the first connector is rotatable relative to the housing. The second retaining member is operatively connected to the hub. The first retaining member is connected to the second retaining member by at least one energy absorbing member that increases in effective length upon activation thereof so that the distance between the first retaining member and the second retaining member increases upon activation of the energy absorbing system.

The energy absorbing member can, for example, include at least a first length of material connected to a second length of material via tear elements which tear to absorb energy upon activation of the energy absorbing system.

The retractable lifeline system can, for example, further include at least one breakable connector connecting the first retaining member to the second retaining member. The breakable connector breaks or disconnects upon a first load such that first retaining member separates from the second retaining member by an observable distance to provide an observable indication that the first load has been experienced.

The energy absorbing member can, for example, be activated upon or after breaking of the breakable connector.

Upon activation, the energy absorbing member can, for example, absorb energy to maintain a load experienced by the lifeline (and the end user) during activation of the energy absorbing member no greater than a predetermined magnitude.

At least a section of the lifeline can, for example, have an initial ultimate tensile load of at least 8000 pounds and be abrasion resistant (that is, satisfying the abrasion test requirement set forth in the ANSI/ASSE Z359.13 2009 standard) such that the section of the lifeline is available for tie-back anchoring using the second connector. The section of the lifeline can, for example, be at least partially retractable within the housing.

In a further aspect, a retracting lifeline system includes a housing, a connector attached to the housing, the connector (which can, for example, be rotatable relative to the housing), a lifeline, and a hub around which the lifeline is coiled within the housing. The housing includes an opening through which the lifeline exits the housing. The hub is tensioned to rotate in a first direction to cause coiling of the lifeline around the hub and retraction of the lifeline. The retracting lifeline system further includes a stop connected to the lifeline. The stop includes at least a first member extending from at least a first surface of the lifeline to abut the opening upon retraction and prevent further retraction of the lifeline. The distance the first member extends from the first surface can, for example, vary to increase from a perimeter of the first member to an inward portion of the first member.

The stop can also include at least a second member extending from at least a second surface of the lifeline to abut the opening upon retraction and prevent further retraction of the lifeline. The distance the second member extends from the second surface can, for example, vary to increase from a perimeter of the second member to an inward portion of the second member. The first member can, for example, be connected to the second member by a connecting member passing through the lifeline. The lifeline can, for example, include or be formed from webbing. The first member can, for example, have a generally frusto-conical shape, and the second member can, for example, have a generally frusto-conical shape. The connecting member can, for example, include a rivet. The stop can, for example, be formed from a metal such as stainless steel.

The distance the first member extends from the first surface can, for example, be at a minimum at the perimeter of the first member, and the distance the second member extends from the second surface can, for example, be at a minimum at the perimeter of the second member. In a number of embodiments, the distance that each of the first member and the second member extends from the first and second surfaces, respectively, increases linearly from the perimeters thereof toward an inward portion thereof.

At least a section of the lifeline can, for example, have an initial ultimate tensile load of at least 8000 pounds and be abrasion resistant (that is, satisfying the abrasion test requirement set forth in the ANSI/ASSE Z359.13 2009 standard) such that the section of the lifeline is available for tie-back anchoring using the second connector. The section of the lifeline can, for example, be at least partially retractable within the housing.

In another aspect, a retracting lifeline system includes a housing, a first connector attached to the housing, a lifeline, and a hub to which the lifeline is attached at a first end of the lifeline and around which the lifeline is coiled within the housing. The housing includes an opening through which the lifeline exits the housing. The hub is tensioned to rotate in a first direction to cause retracting of the lifeline and coiling of the lifeline around the hub. The retracting lifeline system further includes a first retaining member and a second retaining member. The first retaining is connected to a connector extending from the housing, which is connected to the first connector. The second retaining member is operatively connected to the hub. At least one breakable connector connects the first retaining member to the second retaining member. The breakable connector breaks or disconnects upon experiencing a first load such that first retaining member separates from the second retaining member by an observable distance to provide an observable indication that the first load has been experienced.

In a number of embodiments, the first retaining member is further connected to the second retaining member by at least one energy absorbing system that increases in effective length upon activation thereof so that the distance between the first retaining member and the second retaining member increases upon activation of the energy absorbing system.

In a number of embodiment, the connector extending from the housing can, for example, be rotatable relative to the first retaining member. The connector extending form the housing can, for example, be connected to the first connector such that the first connector is rotatable relative to the housing.

In a further aspect, a method of protecting a person in the case of a fall from a height, includes: providing a retractable lifeline system as set forth above. The retractable lifeline system can, for example, include at least a section of lifeline that has an initial ultimate tensile load of at least 8000 pounds and be abrasion resistant (that is, satisfying the abrasion test requirement set forth in the ANSI/ASSE Z359.13 2009 standard) such that the section of the lifeline is available for tie-back anchoring using the second connector. The section of the lifeline available for tie-back anchoring can, for example, be at least partially retractable within the housing.

In a further aspect, a method of operating a retractable lifeline system includes at least partially retracting a section of a lifeline within a housing of the retractable lifeline system, wherein the section of the lifeline has an initial ultimate tensile load of at least 8000 pounds and is abrasion resistant (that is, satisfying the abrasion test requirement set forth in the ANSI/ASSE Z359.13 2009 standard) such that the section of the lifeline is available for tie-back anchoring using a first connector attached to the lifeline. In a number of embodiments, the retractable lifeline system includes the housing; a second connector attached to the housing, the lifeline; and a hub to which the lifeline is attached at a first end of the lifeline and around which the lifeline is coiled within the housing. The housing includes an opening through which the lifeline exits the housing. The hub can, for example, be tensioned to rotate in a first direction to cause retracting of the lifeline and coiling of the lifeline around the hub.

The devices, systems and/or methods, along with the attributes and attendant advantages thereof, will best be appreciated and understood in view of the following detailed description taken in conjunction with the accompanying drawings.

BRIEF DESCRIPTION OF THE DRAWINGS

FIG. 1A illustrates a side view of an embodiment of a retractable lifeline system.

FIG. 1B illustrates a front view of the retractable lifeline system of FIG. 1A.

FIG. 1C illustrates a perspective view of the retractable lifeline system of FIG. 1A.

FIG. 5A illustrates a front perspective view of another embodiment of a retractable lifeline support system of the present invention having a connector that is operable to connect the support system to a D ring.

DETAILED DESCRIPTION

Figure 2A:
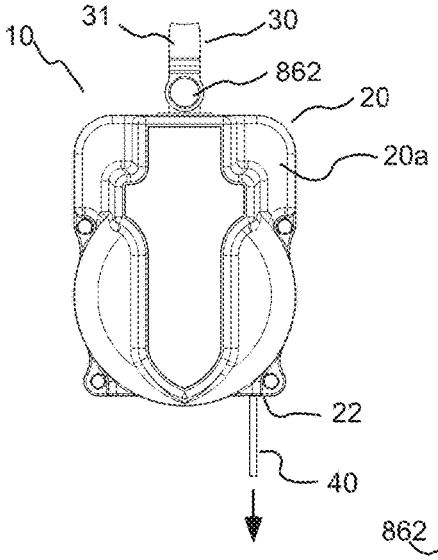
FIG. 2A illustrates a front view of the retractable lifeline system of FIG. 1A wherein the lifeline is being extended from the housing.

As used herein and in the appended claims, the singular forms "a," "an", and "the" include plural references unless the content clearly dictates otherwise. Thus, for example, reference to "a connector" includes a plurality of such connectors and equivalents thereof known to those skilled in the art, and so forth, and reference to "the connector" is a reference to one or more such connectors and equivalents thereof known to those skilled in the art, and so forth.

FIGS. 1A through 5G illustrate an embodiment of a self-retracting or retracting lifeline system 10. A housing or cover 20 can, for example, be formed in two halves 20*a* and 20*b* (see, for example, FIG. 4) as known in the art and serves to protect internal mechanisms of retracting lifeline system 10 from damage. In general, however, housing 20 does not otherwise significantly affect the operation of such internal mechanisms. Retracting lifeline system 10 can, for example, be connected via a swiveling and/or rotating connector 30 to, for example, a harness 400 via a dual lifeline system support 220 as illustrated in FIGS. 5A through 7B. Alternatively, connector 30 can be replaced by or connected to another connector such as a carabiner or snap hook as known the art, which can be connected to the user (for example, to D ring 410). In such embodiments, a distal end 42 of a lifeline or lanyard 40, which retractably extends from housing 20 (and formed, for example, a polymeric web material), is attached to some fixed object or anchor via, for example, a connector such as snap hook 600. In other embodiments, distal end 42 of lifeline or lanyard 40 is connected to a harness 400 worn by the user and connector 30 and/or other connector(s) is connected to a fixed anchor.

Figure 2B:
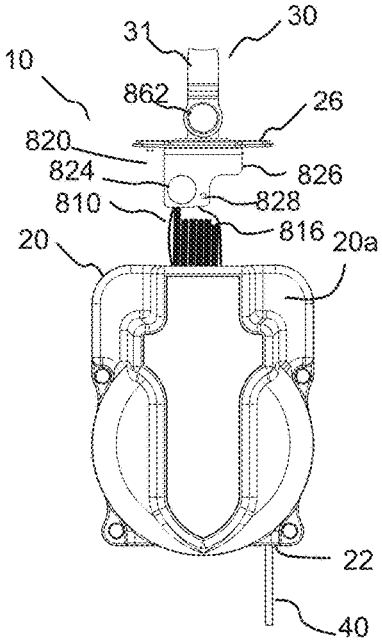
FIG. 2B illustrates a front view of the retractable lifeline system of FIG. 1A wherein a load indicator has been activated in the case of a fall.
Figure 2C:
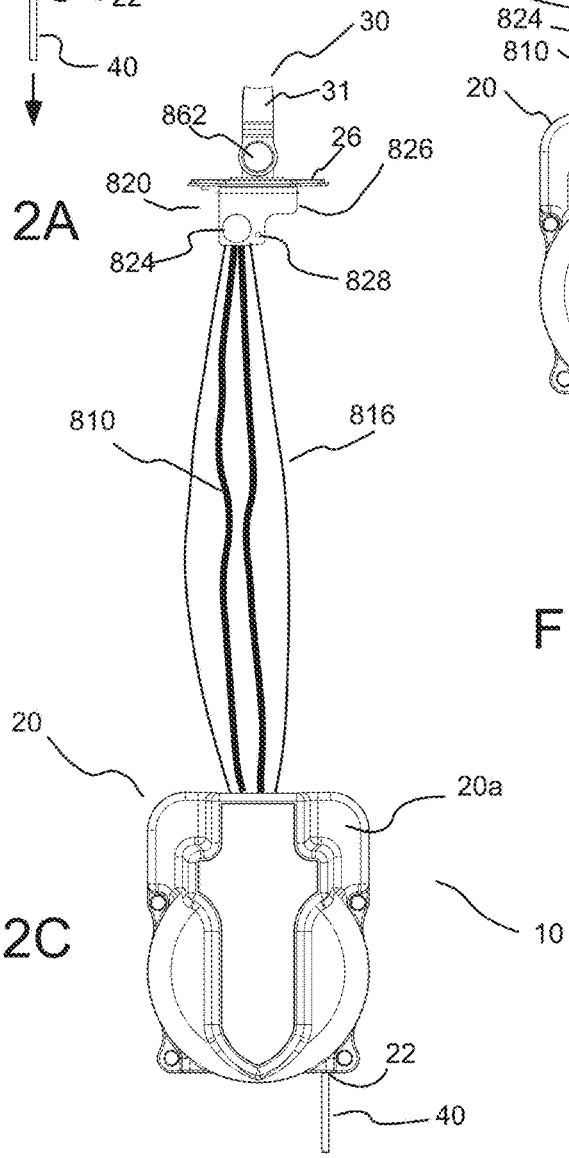
FIG. 2C illustrates a front view of the retractable lifeline system of FIG. 1A wherein the shock absorbing system has been activated.
Figure 2D:
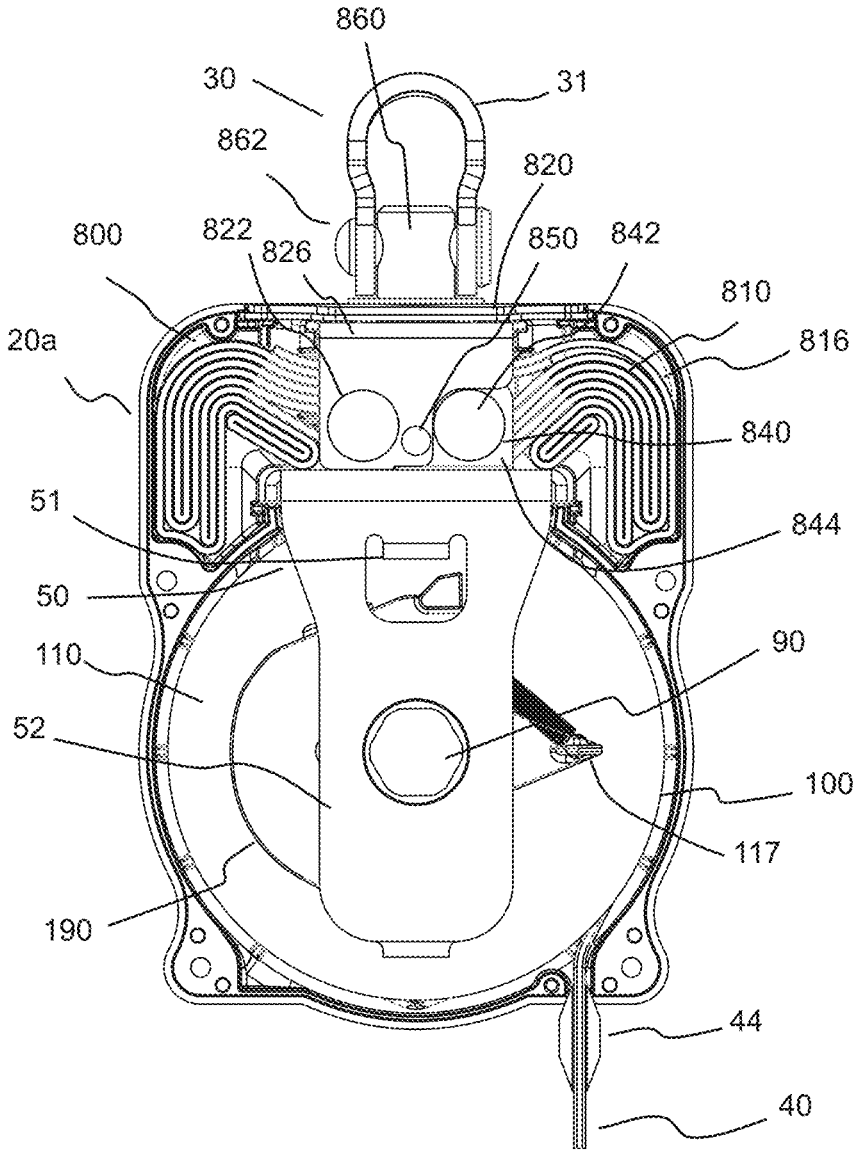
FIG. 2D illustrates a front view of the retractable lifeline system of FIG. 1A with one side of the housing removed, wherein the load indicator has not been activated.
Figure 2E:
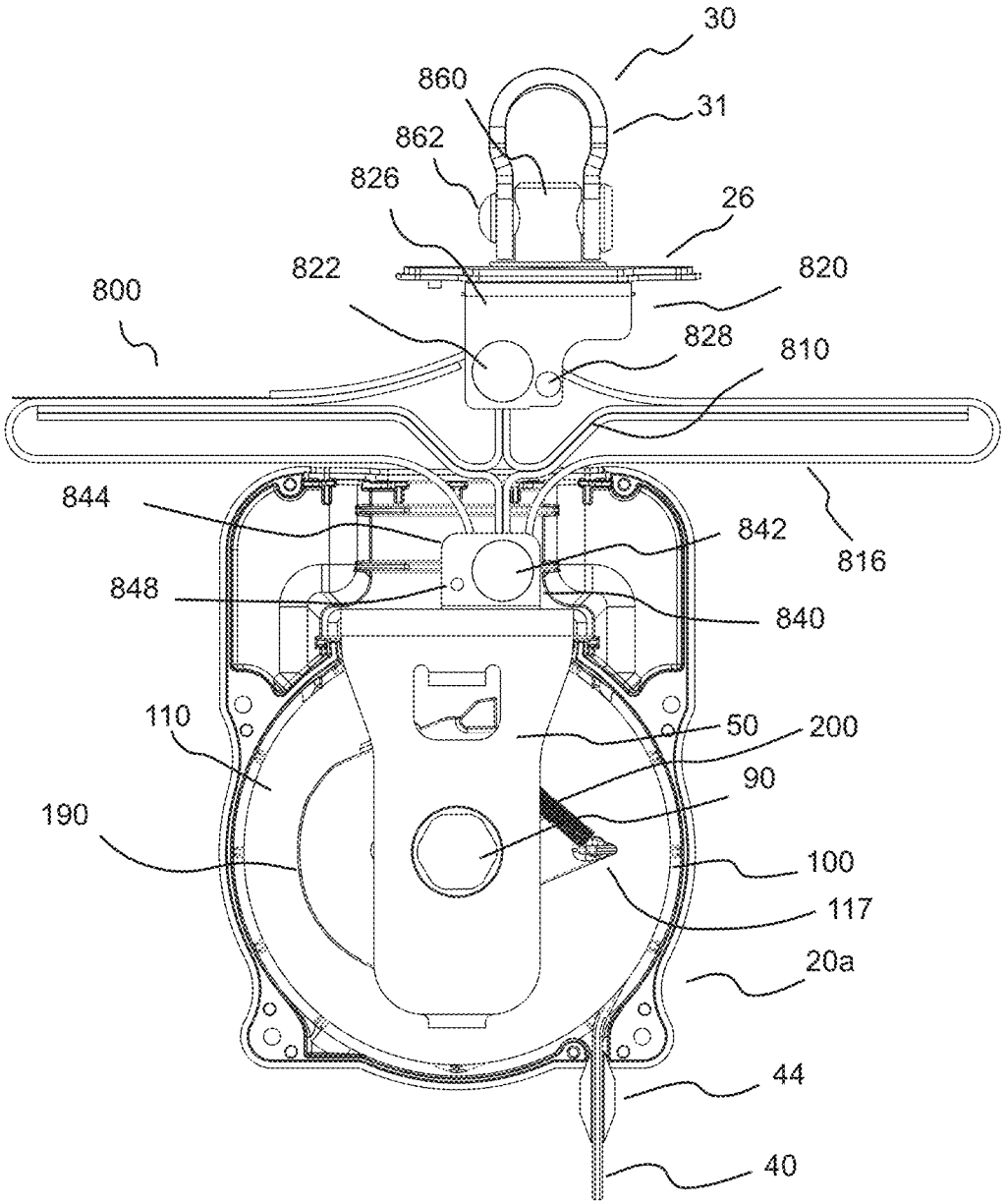
FIG. 2E illustrates a front view of the retractable lifeline system of FIG. 1A with one side of the housing removed wherein the load indicator has been activated and the energy absorbing system is removed from the housing but not activated.
Figure 2F:
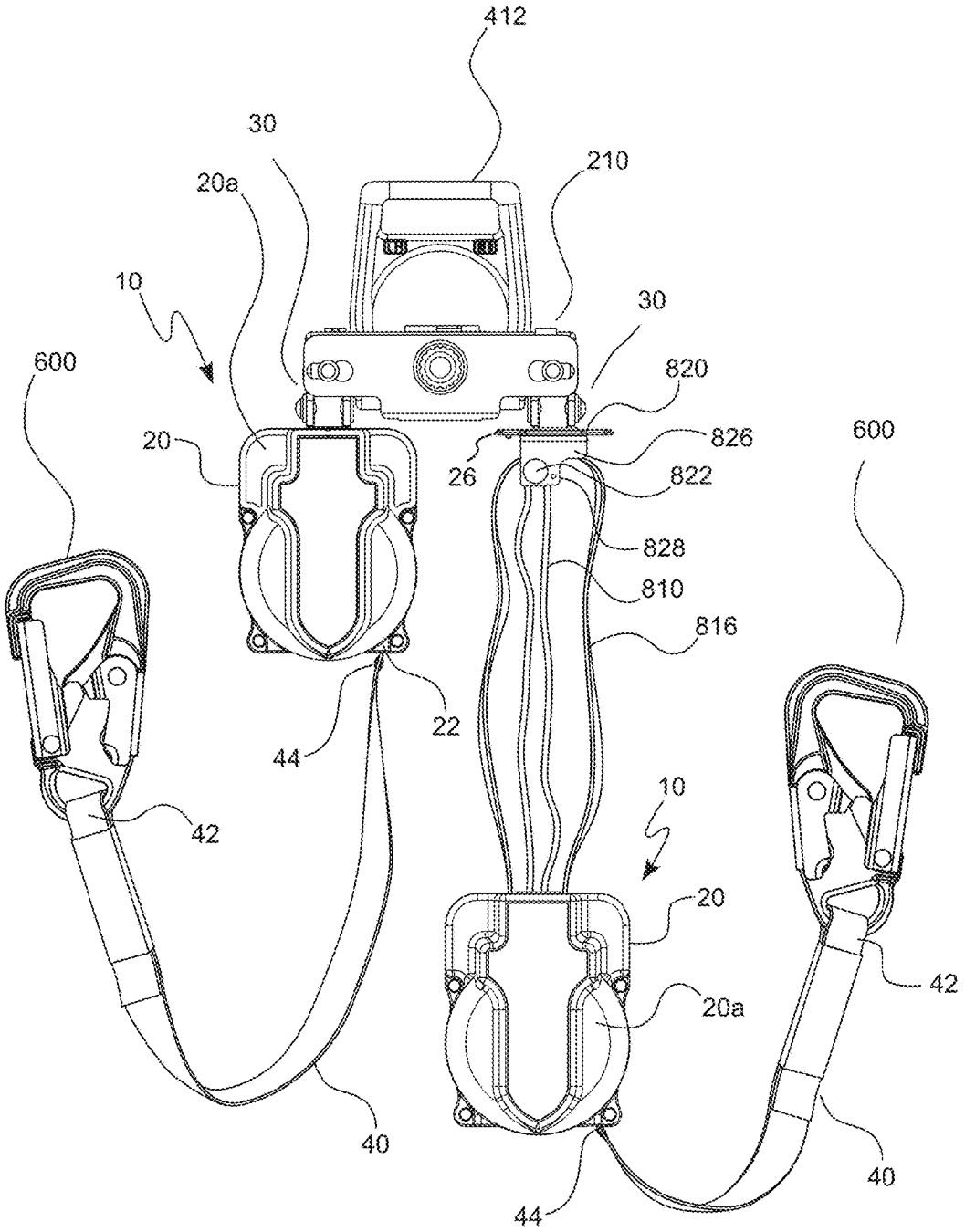
FIG. 2F illustrates two of the retractable lifeline systems of FIG. 1A attached to a support system wherein the energy or shock absorbing system of one of the retractable lifeline systems has been activated.
Figure 2G:
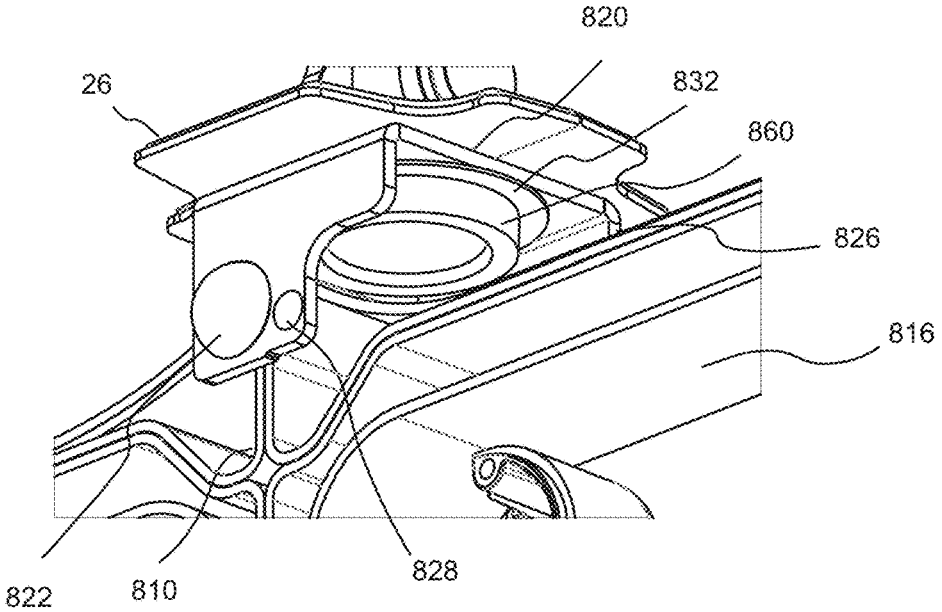
FIG. 2G illustrates an enlarged perspective view that portion of shock absorbing system of the retractable lifeline system of FIG. 2E that remains fixed to the support system.
Figure 2H:
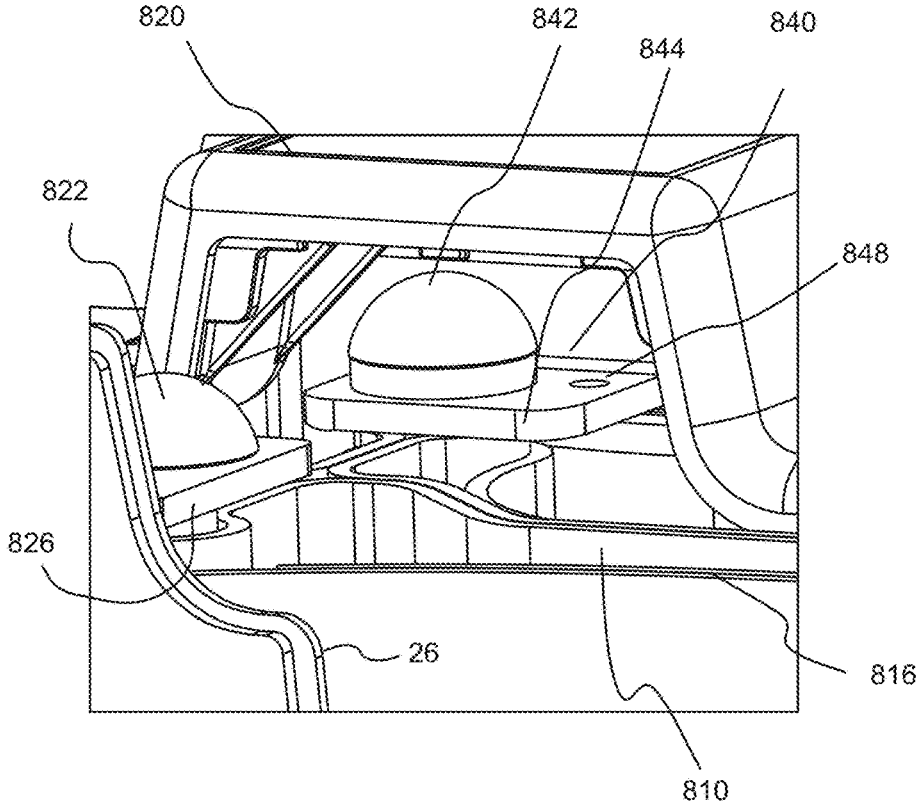
FIG. 2H illustrates an enlarged perspective view that portion of the retractable lifeline system of FIG. 2E that remains fixed to the housing of the retractable lifeline system.
Figure 2K:
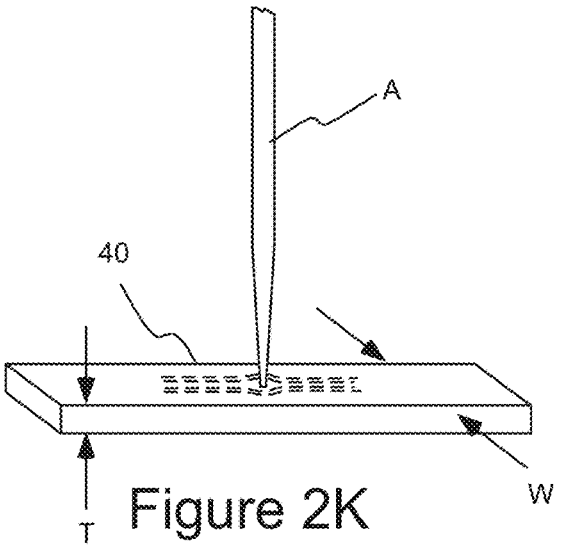
FIG. 2K illustrates a perspective view of a method of forming a passage in the lifeline using, for example, an awl to enable attachment of a stop thereto.
Figure 2I:
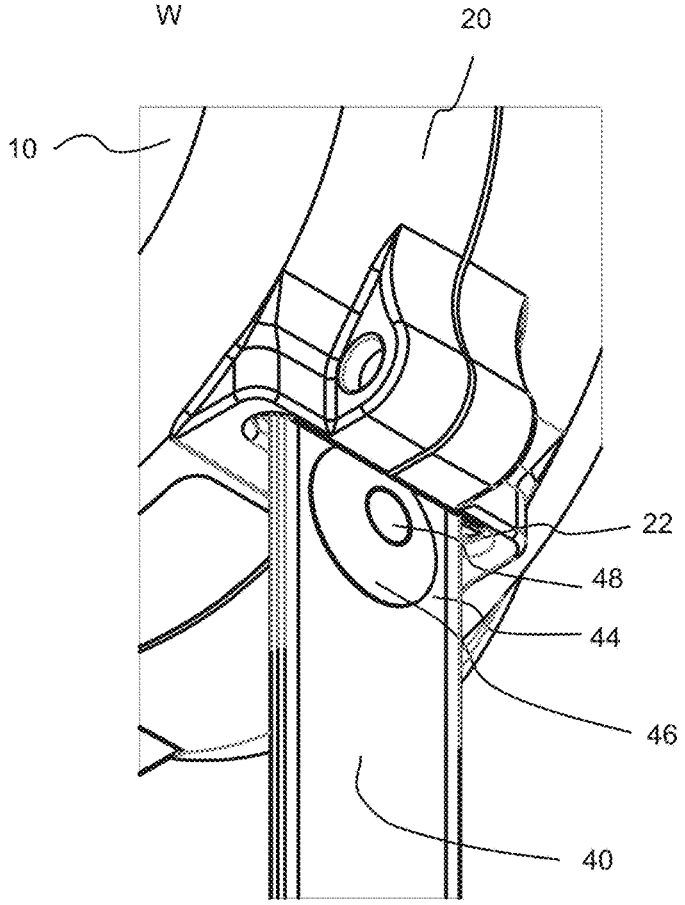
FIG. 2I illustrates an enlarge perspective view of an opening in the housing of the retractable lifeline system with an embodiment of a lifeline stop in abutting contact with the opening.
Figure 2J:
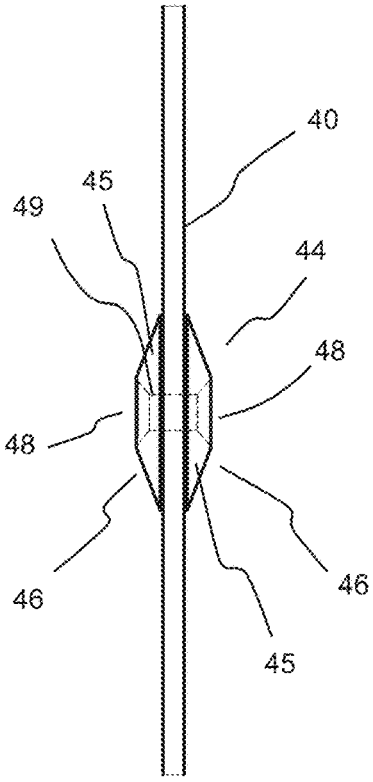
FIG. 2J illustrates a side view of the lifeline and lifeline stop.
Figure 2L:
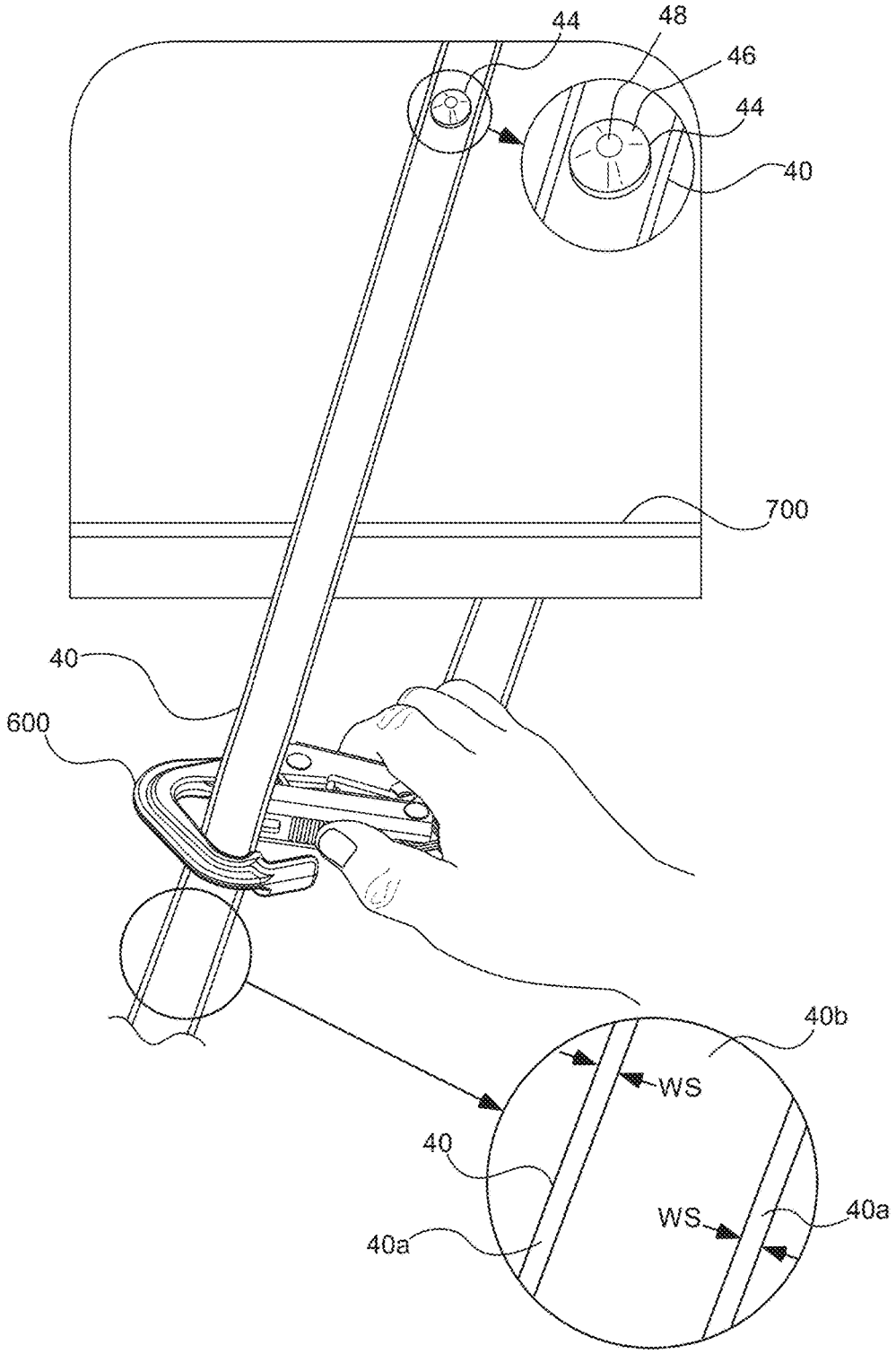
FIG. 2L illustrates "tie back" attachment of the lifeline to an anchor (an I beam).

As illustrated, for example, in FIG. 2L, retracting lifeline system 10 can be used in a "tie-back" application. In a tie-back application, lifeline 40 of the retracting lifeline system 10 is wrapped around an acceptable anchorage structure, such as I-beam 700, a pipe, a concrete column etc. Snap hook 600 is connected back onto lifeline 40, creating a secure anchorage for the user. As illustrated in FIG. 2L, snap hook 600 can be connected to lifeline 40 in a choking fashion. The user ensures that lifeline 40 is captured in snap hook 600 and the gate of snap hook 600 is completely closed, locked, and not obstructed in any way. By enabling tie-back, retracting lifeline system 10 provides a connecting device with a readily adaptable anchorage connector, lowering the overall cost and simplifying use. In that regard, the end user does not have to buy and install a separate, dedicated anchorage connector. Moreover, retracting lifeline system 10 provides more flexibility as to where a user can anchor the user's personal fall arrest or retracting lifeline system (as compared to systems in which tying back is not possible). Snap hook 600 can alternatively be connected directly to a suitable anchorage.

Overhead anchorage is typically recommended. However, in certain circumstances, lifeline 40 can be anchored below the harness back D-ring 410. Fall clearance should be calculated from the anchor point when anchoring below the harness back D-ring 410 and the distance between the anchor and harness D-ring 410 must be added into the calculation as known in the art. See, for example, Calculating Fall Clearance Distance in the Miller Self-Retracting Lifelines & Fall Limiters instruction manual available from Sperian Fall Protection, Inc. of Franklin, Pa.

Unlike currently available retracting lifeline systems, a user can tie back at generally any position along lifeline 40. Also unlike such currently available retracting lifeline systems, at least a portion of lifeline 40 over which tie-back can occur is retractable onto drum assembly 100 (see FIG. 4, which is discussed below) of retracting lifeline system 40. In a number of embodiments, lifeline 40 is, for example, formed from a heavy-duty, cut-resistant, abrasion-resistant webbing which exhibits an ultimate tensile load or minimum breaking strength (that is, the measure load at failure) suitable for fall protection in tie-back applications over the entire length thereof. Likewise, lifeline 40 is sufficiently abrasion resistant over its entire length to enable tie-back connections. As some abrasion and associated decrease in ultimate tensile load may result from tie-back connections, increased initial (that is, prior to abrasion) ultimate tensile load is desirable for lifeline 40 (as compared to lifelines not used in tie-back applications). In general, webbing and synthetic rope lifeline materials for use in retracting lifeline systems in the United States of America is typically required to exhibit an ultimate tensile load or minimum breaking strength of 4,500 lbs. (20kN). See ANSI Z359.1-1992 Standard Sections 3.2.8.5.1 and 3.2.8.5.2. In several embodiments of lifeline 40, lifeline 40 has an initial ultimate tensile load of at least 8000 pounds, at least 9,000 pounds, at least 10,000 pounds, at least 12,000 pounds or even higher (as determined in a static pull test as known in the art).

Suitable initial ultimate tensile load and cut-resistance and/or abrasion resistance in lifeline 40 enables connection or tying back directly to lifeline 40 at any position thereon in a choking fashion, eliminating the need of a thick protective sleeve or extension that cannot be wound around a drum assembly and/or drawn within a housing. As discussed above, as used herein, "abrasion resistant" is defined as being in compliance with the abrasion test requirement set forth in the ANSI/ASSE Z359.13 2009 standard (see, for example, sections 3.2.6 and 4.1.9 through 4.1.12). The ANSI/ASSE Z359.13 2009 standard incorporates Federal Test Method STD. No. 191A, Method 5309, Abrasion Resistance of Textile Webbing. Those standards are provided as appendices to U.S. Provisional Patent Application Ser. No. 61/321,491.

Lifeline 40 provides the strength, abrasion and cut resistance necessary for tie-back applications, and yet is sufficiently flexible to retract back into a properly sized housing 20 using standard tensioning mechanisms such as a steel coil spring. In a number of embodiments, in addition to the retraction tension required to retract the weight of lifeline 40 (including the attached connector), the retraction tension on lifeline 40 is not less than 1.25 pounds (0.6 kg) nor more than 25 pounds (11.4 kg) at any point in the range of motion provided by the line. ANSI/ASSE Z359.1 1992 Section 3.2.8.6. In several embodiments, the retraction tension was not less than 1.5 and not more than 8 pounds or not less than 1.5 pounds and not more than 5 pounds.

In a number of embodiments, webbing lifelines developed for use in retracting lifeline system 10 were woven from at least two fiber materials to include an interior (referring to the general position in the woven webbing) of a high strength or high tenacity fiber material and an exterior of an abrasion resistant material. The high strength or high tenacity fibers can, for example, have a breaking tenacity of at least 20 grams per denier (g/den). In a number of embodiments, the high strength or high tenacity fibers have a breaking tenacity between approximately 20 g/den and approximately 35 g/den. Examples of suitable high strength or high tenacity fiber materials include VECTRAN™ fibers (high strength, liquid crystalline aromatic polyesters), available from Kuraray America, Inc. of Houston, Texas, SPECTRA® fibers (ultra-high molecular weight polyethylene material) available from Honeywell of Virginia, USA, KEVLAR® fibers (para-aramid synthetic fibers) available from E. I. du Pont de Nemours and Company of Wilmington, Del. USA (or other aramid fiber material) or DYNEEMA® fibers (an ultrahigh molecular weight polyethylene material) available from DSM Dyneema of Geleen, The Netherlands. In a number of embodiments, the high strength or high tenacity material also exhibits relatively low elongation. In a number of embodiments, the elongation at break of the high strength or high tenacity fibers was in the range of 2.4 to 3.7%. Use of denser high strength or high tenacity fibers (for example, KEVLAR® and VECTRAN® fibers are denser than SPECTRA® and DYNEEMA® fibers) results in a thinner webbing.

As described above, in a number of such embodiments, the webbing lifeline further includes an exterior (referring once again, to the general position in the woven webbing) of an abrasion resistant material such as spun yarns or spun polymeric fibers. Many different abrasion resistant spun yarns can be used. The abrasion resistant yarns or fibers can also provide cut resistance. In a number of embodiments, spun polyester fibers were used as the abrasion resistant material. The material forming the exterior of the webbing can also, for example, provide UV protection for the inner, high strength material. An example of a material developed for use herein is webbing product no. K2197 available from Technical Textiles of Charlotte, N.C., which includes a weave of high-strength VECTRAN fibers and spun polyester fibers as described above to produce a lifeline having an initial ultimate tensile load of at least 8000 pounds and abrasion resistance as defined above.

The interior, high strength fiber can, for example, be of a first color and at least a portion the exterior, abrasion resistant fiber can be of a second, different color. The interior, high strength fiber can, for example, be chosen or formed to be white, and at least a portion of the exterior, abrasion resistant fiber can be black. In this manner, abrasion resulting in damage of the exterior portion can be apparent as the differently colored interior portion will become visible.

In the case of a number of materials, some abrasion on the outside edges of lifeline 40 will not significantly adversely affect the performance of lifeline 40. As, for example, illustrated in FIG. 2L, a certain width WS on each lateral side (which can be the same or a different width for each lateral side or be constant or varying over the length of lifeline 40) of the exterior of lifeline 40 can be formed (for example, via coloring of the exterior fibers) to have generally the same or similar color to the color (for example, white) of the interior fibers, thereby forming edge "striping" 40*a* and a central section 40*b*, which has a color (for example, black) substantially different from the color of the interior fibers. In this manner, abrasion resulting in exposure of the interior fibers on the edges of lifeline 40 (within width WS of striping sections 40*a*), which does not significantly adversely affect the performance of lifeline 40 (even in tie-back applications) need not be apparent to the user. However, abrasion resulting in exposure of the interior fibers within or extending within central section 40*b*, which can significantly adversely affect the performance of lifeline 40, will be readily apparent to the user.

The size and weight of retracting lifeline housing 20 are considerations in designing retracting lifeline system 10. Users can, for example, wear one or more of retracting lifeline systems 10 for eight hours or more. Excessive fatigue or discomfort associated with overly large or heavy retracting lifeline systems can lead to injury or to lack of compliance in usage retracting lifeline systems. The width, thickness and length of lifeline 40 affect the size and weight of drum assembly 100 and thereby other components of retracting lifeline system 10, including housing 20.

In a number of embodiments, lifeline webbing has a width W (see FIG. 2K) of no greater than approximately 1.25 or no greater than approximately 1.00 inches and a thickness T of no greater than approximately 0.125 inches, 0.1 inches, 0.09 inches or 0.075 inches. In several embodiments, lifeline 40 was formed from VECTRAN fibers and spun polyester fibers as described above to have a width W of approximately 1.00 inch, a thickness T of approximately 0.075 inches, and an initial ultimate tensile load of at least approximately 9,000 pounds or at least 10,000 pounds.

The length of lifeline 40 can, for example, be in the range of 4 to 12 feet. Other lengths are also possible. In several embodiments, the length of lifeline 40 was between approximately 4.5 feet and 8 feet. Such ranges of length of lifeline 40 provide length for tie-back around a wide range of anchorages, for movement and for fall arrest, while providing a reasonable size and weight for housing 20 and the components therein.

Although tie-back can be effected at any position along lifeline 40, and lifeline 40 can be fully retracted within housing 20, a length or portion of lifeline 40 can, for example, be provided or maintained exterior to housing 20. Maintaining a length of lifeline 40 exterior to housing 20 enables the user to, for example, readily connect snap hook 600 (or other connector) to a connector 610 (see FIGS. 7A and 7B on a front portion of safety harness 400 (or other safety harness) to provide ready access thereto. Moreover, maintaining a length of lifeline 40 outside of housing 20 enables reduction in the size and weight of drum assembly 100, housing 20 etc. A length L (see FIG. 7B) from a point where a stop 44 stops lifeline 40 from retracting within housing 20 to a point at the distal end of snap hook 600 (or other connector) can, for example, be 24 inches or less as set forth in ANSI Standard Z359.1-1992 Section 3.2.8.6. In several embodiments, length L was approximately 20 inches. Such a length L extending from housing 20 can, for example, provide easy access to snap hook 600 and lifeline 40 without creating a snagging and/or tripping hazard.

As illustrated, for example, in FIGS. 1A, 1B, 2F, and 2I though 2L, in several embodiments, stop 44 can, for example, have a relatively low and/or gradually changing or sloping profile. As illustrated, for example, in FIG. 2I, stop 44 operates to abut opening 22 in housing 20 through which lifeline 40 passes to prevent further retraction. In the illustrated embodiment, stop 44 is formed in two generally identical sections or halves 45. Each section 45, includes a sloped or ramped portion 46 in which the thickness (that is, the distance each section 45 extends from a surface of lifeline 40) of section 45 increases linearly (from a minimum) at the outer perimeter as the radius decreases (that is, traveling toward an inner portion thereof). In other words, the thickness is at a minimum at a perimeter of stop 44 and increases toward the center of stop 44 to a thickness of at least the width of opening 22. In the illustrated embodiment, each section 45 also includes generally central section 48 of a generally constant width (thereby, providing a generally frusto-conical shape). The thickness of each section of the stop can also vary in a curved or curvilinear manner.

A connector such as rivet 49 (which can, for example, form central section 48) passes through each section 45 and lifeline 40, sandwiching lifeline 40 between each section 45 to retain stop 44 in connection with lifeline 40. To prevent excessive damage to lifeline 40, in forming an opening to enable passage of rivet 49 therethrough, an awl A (see FIG. 2K) or other tapered instrument was, for example, used to spread the fibers of lifeline 40 while minimizing damage thereto. As illustrated, for example, in FIG. 1A, this process results in some bulging 43 of the sides of lifeline 40 in the vicinity of stop 44. The inventors have discovered that a passage for rivet 49 or another connector formed in such a manner (unlike cutting, boring or other techniques in which significant fiber damage occurs) results in insignificant weakening of lifeline 40.

Unlike prior stops (for example, a section of lifeline stitched back on itself to create an area of increased width), the low profile and/or sloped surfaces of stop 44, prevent catching or interference of stop 44 with anchors such as I beams or other anchors, which can interfere with, for example, tie-back installation. Stop 44 can, for example, be formed from a durable material such as a metal.

Figure 4:
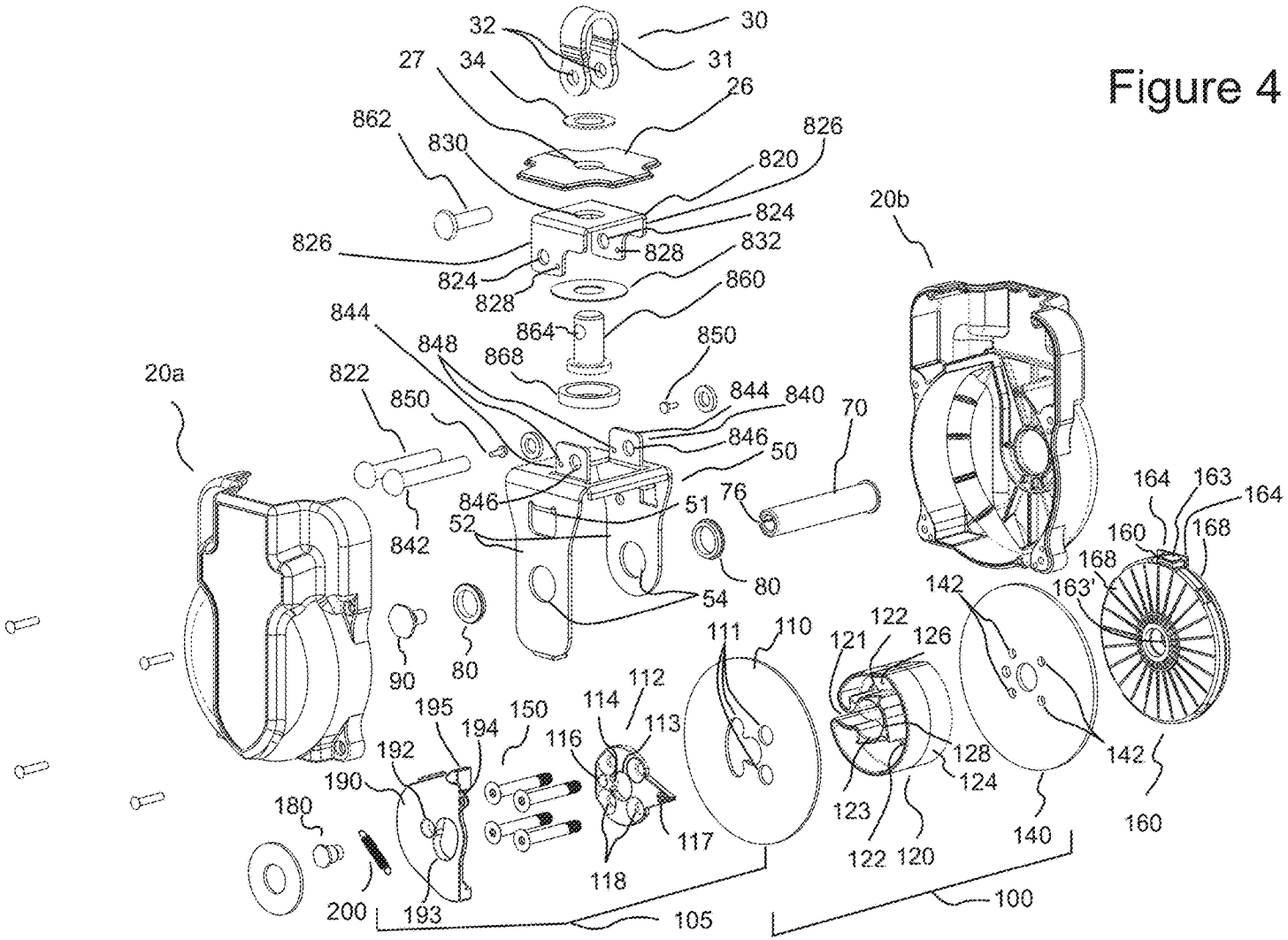
FIG. 4 illustrates a perspective, exploded or disassembled view of the retractable lifeline system of FIG. 1A.
Figure 5B:
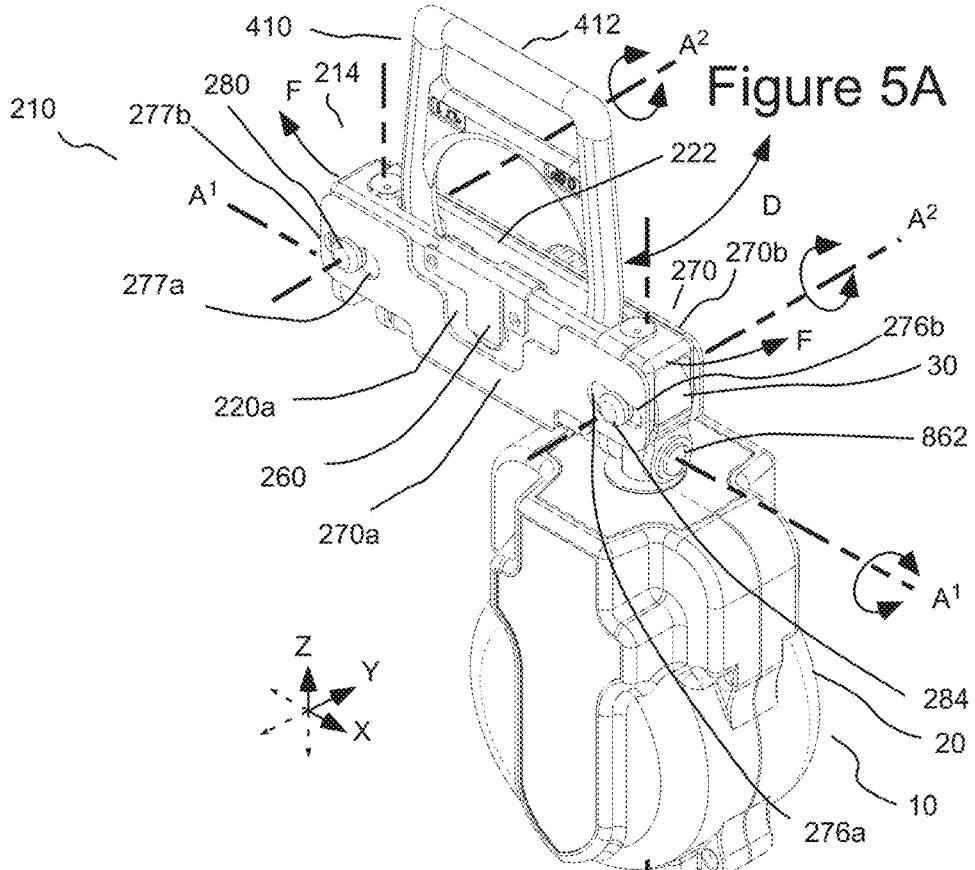
FIG. 5B illustrates a rear perspective view of the system of FIG. 5A.
Figure 5B:
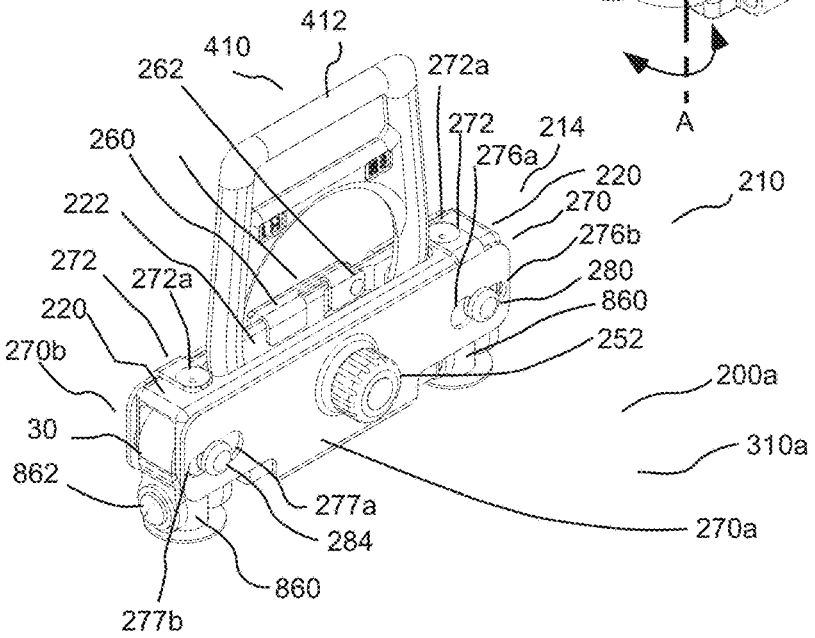
Figures 5C, 5D:
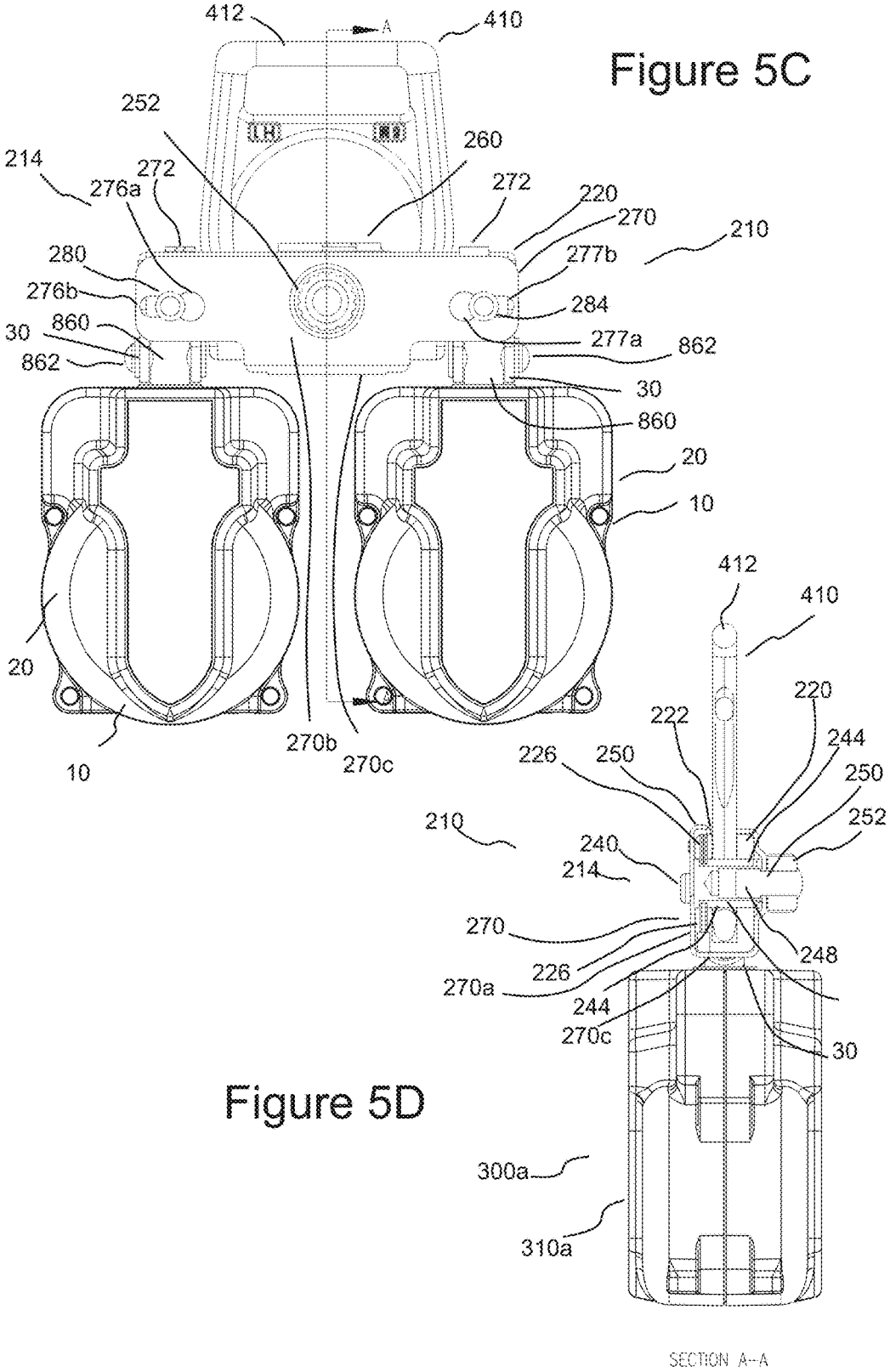
FIG. 5C illustrates a rear view of the system of FIG. 5A.
FIG. 5D illustrates a side, partially cutaway view (along section A-A of FIG. 5C) of the system of FIG. 5A.
Figure 5E:
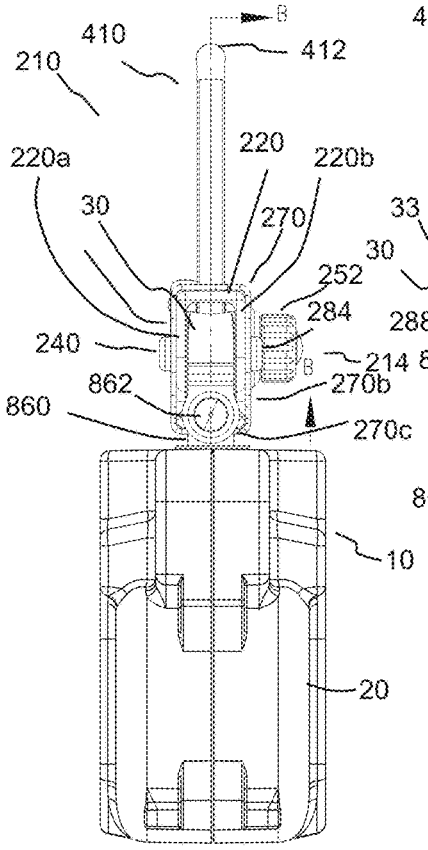
FIG. 5E illustrates a side view of the system of FIG. 5A.
Figure 5F:
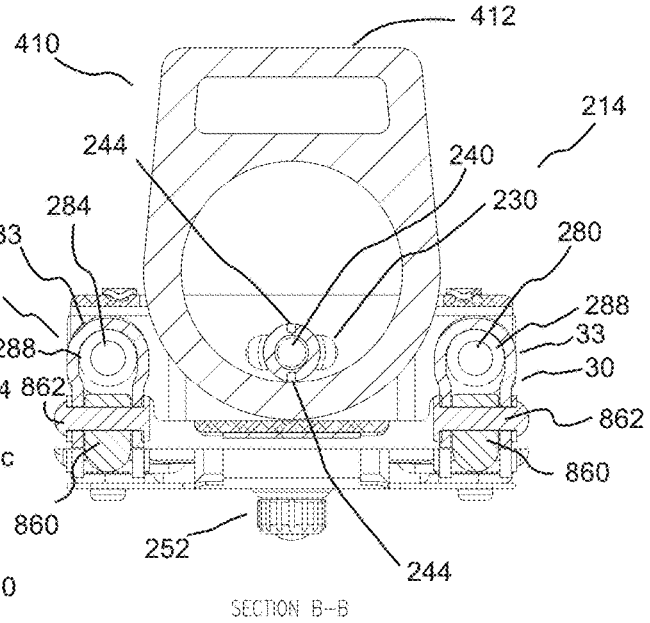
FIG. 5F illustrates a cross-section view of a portion of the system of FIG. 5A along section B-B of FIG. 5E.
Figure 5G:
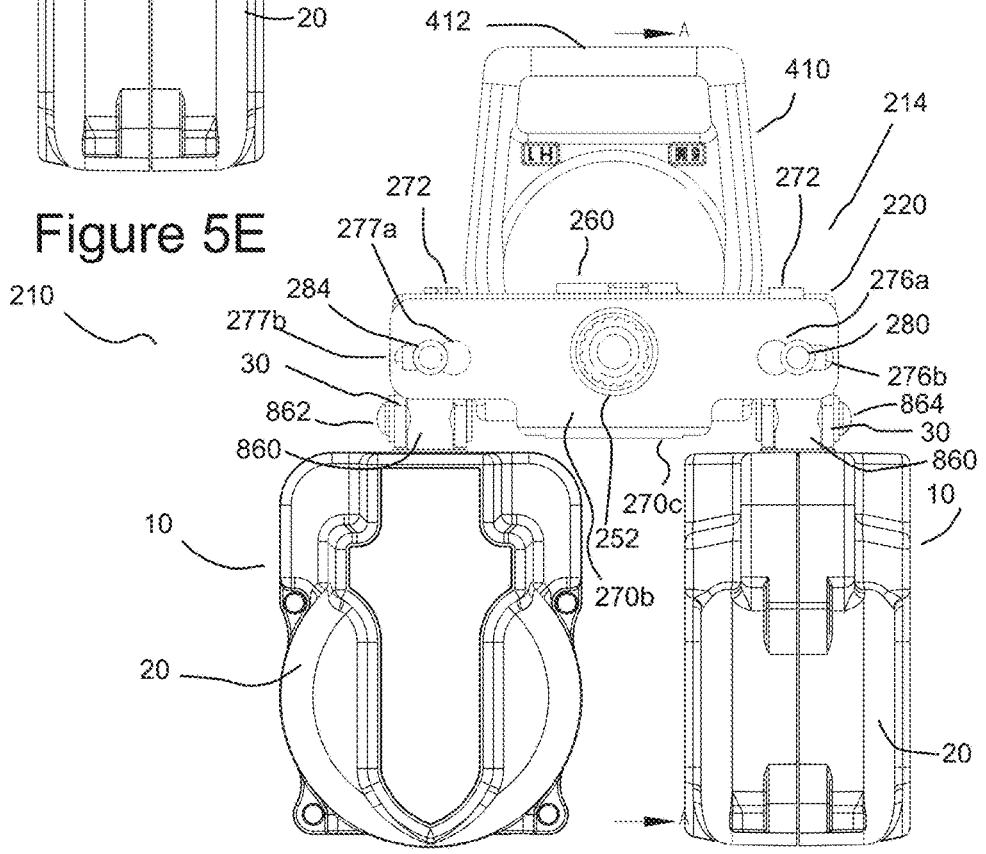
FIG. 5G illustrates a front view of the system of FIG. 5A wherein one of the attached retracting lifeline systems has been rotated about its central, longitudinal axis independent of the position of the other retracting lifeline system.
Figure 5H:
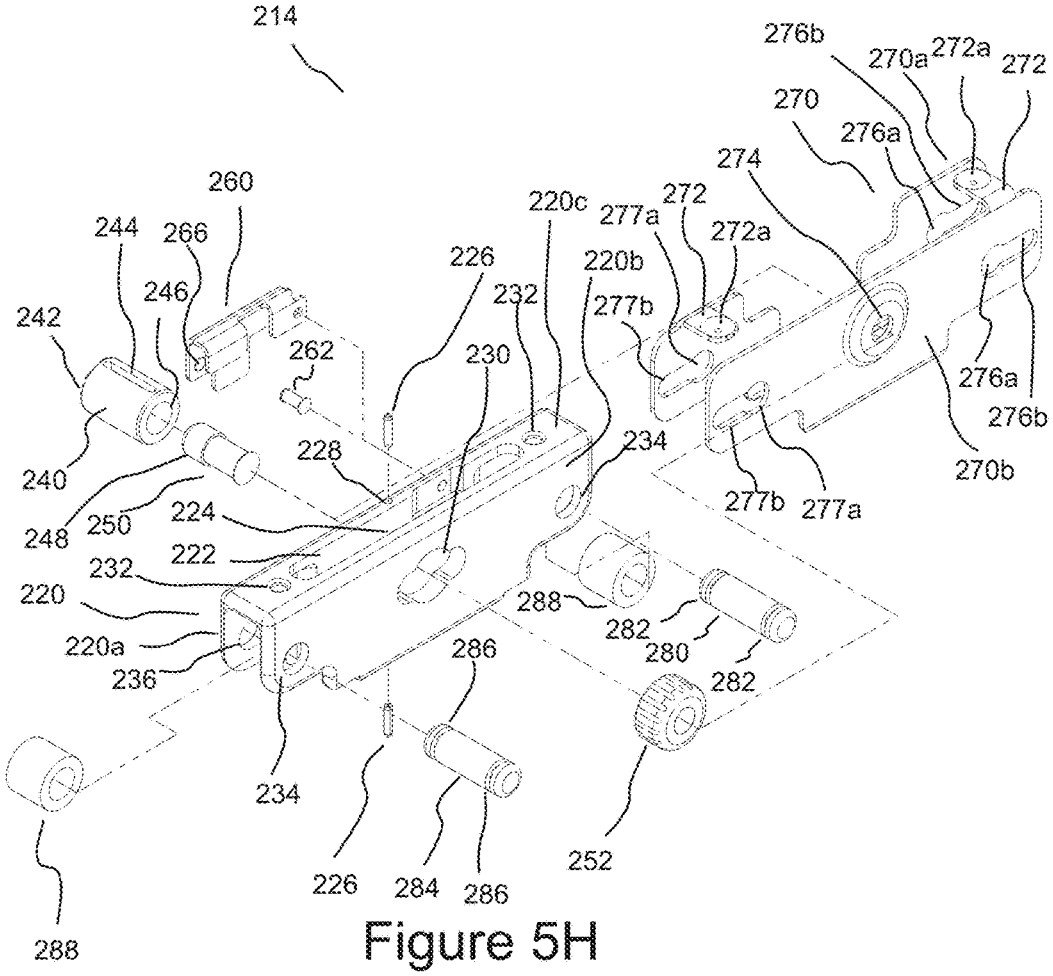
FIG. 5H illustrates a rear, perspective exploded view of the connector of the system of FIG. 5A.
Figure 5I:
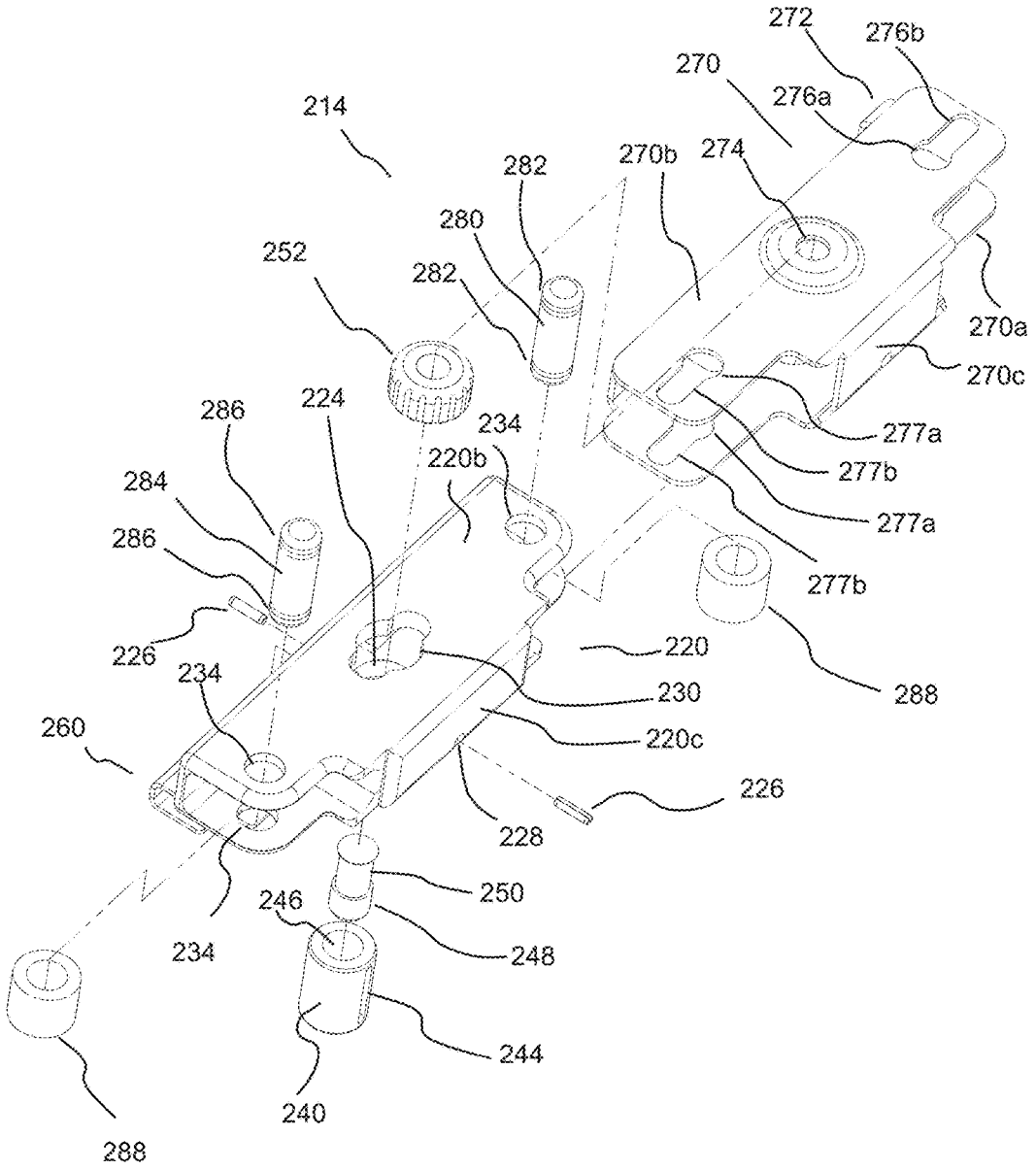
FIG. 5I illustrates a bottom, perspective exploded view of the connector of the system of FIG. 5A.

FIG. 4 illustrates components of retracting lifeline system 10 in a disassembled state. A number of components rotate relative to a frame member 50 (which includes extending sections 52) about a shaft 70. In several embodiments, frame member 50 and shaft 70 were formed, for example, from a metal such as stainless steel. In the embodiment illustrated in FIG. 4, frame member 50 (and extending sections 52) are formed integrally as part of a U shaped length of metal (for example, stainless steel). Shaft 70 rotates within shaft bushings 80 that are seated within holes or passages 54 formed in sections 52 of frame member 50. A flanged retainer or connector 90 (for example, a threaded connector) cooperates with a seating 72 (for example, a threaded seating) formed within shaft 70 to retain shaft 70 in rotatable connection with bushings 80.

A hub or drum assembly 100 of system 10 includes a first hub flange or hub plate 110, a hub or drum 120 around which lifeline 40 (for example, webbing) is coiled, a second hub flange 140, and connectors such as screws 150. In several embodiments, hub plate 110 and hub flange 140 were formed from a metal such as aluminum or stainless steel, while hub 120 was formed from a deformable polymeric material as described in U.S. Patent Application Publication No. 2009/0211847. When assembled, hub plate 110, hub 120, hub flange 140, and screws 150 form hub or drum assembly 100 which rotates on shaft 70. A loop end of lifeline 40 is positioned with a passage 123 formed within hub 120 around shaft 70 to anchor the loop end of lifeline 40 securely within drum assembly 100. The loop end extends through a slot 121 formed in hub 120 and a portion of lifeline 40 is coiled around hub 120, leaving a free end which extends from housing 20.

Shaft 70 is rotationally locked to hub plate 110 via a catch or braking base 112 (formed, for example, from a metal such as case stainless steel) that is connected to hub plate 110 by screws 150. In that regard, braking base 112 includes a passage 113 formed therein through which shaft 70 passes and a radially inward projecting member 114 which engages a radially outward portion of slot 76 of shaft 70. Tension is applied to drum assembly 100 to retract lifeline 40 after extension thereof via a power spring assembly 160 including coiled strap of spring steel inside a plastic housing formed by housing members 168. A radially outward end 163 of spring steel strap can be anchored to frame 50. A radially inward end 163' can engage a radially inward, narrow portion of slot 76 in shaft 70. One housing member 168 of power spring assembly 160 can, for example, be rotationally locked to frame member 50 by a projecting member or stud 164 on housing member 168 which engages frame 50. As described above, lifeline web 40 is anchored to and coiled around hub 120 of drum assembly 100. At assembly, power spring 162 is "wound up" to provide torque to shaft 70 and thus to drum assembly 100. The torque applied to shaft 70 pre-tensions lifeline 40 and causes lifeline 40 to coil up or retract around hub 120 after it has been uncoiled therefrom.

Retracting lifeline system 10 also includes a braking mechanism 105. Retracting lifeline system 10 can, for example, include a braking mechanism as described in U.S. Patent Application Publication No. 2009/0211848. In that regard, a catch 190 (formed, for example, from a metal such as cast stainless steel) is pivotably or rotatably mounted (eccentric to the axis of shaft 70) to catch base 112 via a partially threaded pivot member 180 which passes through a passage 192 formed in catch 190 to connect to a threaded passage 116 on catch base 112. The axis of threaded pivot member 180 (and passage 192) preferably corresponds approximately or generally to the center of mass of catch 190. In that regard, pivot member 180 is preferably positioned in the vicinity of the center of mass of catch 190 and preferably as close to the center of mass as possible. Braking mechanism 105 can also include a catch spring 200 having one end which engages a connector 117 (for example, a loop or passage) of catch base 112 and another end which engages a connector 194 (for example, a loop or passage) of catch 190. The force exerted by the catch spring 200 is generally balanced against the rotational inertia of catch 190 so that catch 190 actuates (via centrifugal force) to effect braking only when lifeline web 40 is being pulled from retracting lifeline system 10 at an acceleration rate corresponding, for example, to the beginning of a fall (as described in U.S. Patent Application Publication No. 2009/0211848). For example, catch 190 and catch spring 200 can be readily designed (using engineering principles known to those skilled in the art) to actuate when lifeline 40 is being pulled out at a certain determined acceleration (for example, ½ or ¾ times the acceleration of gravity). For lower accelerations or when the user is extending the web at a constant rate, such as when walking, catch 190 will not actuate and hub assembly 100 will turn freely.

The center of mass of catch 190 is located generally where it pivots or rotates on pivot member 180. Catch 190 will thus maintain its position relative to hub assembly 100, while hub assembly 100 is rotating at a constant angular velocity as when lifeline 40 is being pulled out of retracting lifeline system 10 at a constant rate. That is, catch 190 and catch base 112/hub assembly 100 will rotate as a unit and centrifugal force will not cause catch 190 to rotate about pivot member 180 relative to catch base 112/hub assembly 100. However, if hub assembly 100 experiences a clockwise (in the orientation of FIG. 4) angular acceleration (as is the case when lifeline 40 is being pulled out of retracting lifeline system 10 at an increasing rate) sufficiently high for the rotational inertia of catch 190 to overcome the force of catch spring 200, catch 190 will rotate about pivot member 180 in a second direction (counterclockwise in the illustrated embodiment) relative to catch base 112/hub assembly 100.

When catch 190 is rotated counterclockwise about pivot member 180 relative to hub assembly 100, an abutment section, stop section or corner 195 of catch 190 extends radially outward (because catch pivot 180 is not concentric with shaft 70). In this case, abutment section 195 of catch 190 will abut or catch an abutment member of a stop or abutment member 51 of frame 50. Catch 190 cannot rotate in a counterclockwise direction because of abutment of shaft 70 with an end of curved slot or opening 193 of catch 190. As a result the contact of abutment section 195 with frame 50 and the abutment of slot 193 with shaft 70, the rotation of hub assembly 100 is brought to a halt.

When the user has relaxed the tension on lifeline 40 to allow hub assembly 100 to retract lifeline 40 a short distance, hub assembly 100 rotates counterclockwise (as a result of the tensioning force of tensioning mechanism 160), and abutment section 195 of catch 190 moves away from abutment with frame 50. Catch 190 then rotates (as a result of the biasing force of catch spring 200) about the axis of pivot member 180 clockwise relative to hub assembly 100. At this point, hub assembly 100 is now free to rotate again.

In the illustrated embodiment, screws 150 are passed through passages 118 in catch base 112, passages 111 in hub plate 110, through passages 122 in hub 120 and through passages 142 in hub flange 140 to retain drum assembly 100 and catch base 112 in operative connection.

Hub 120 can, for example, be molded from an integral piece of a polymeric material such as, for example, copolymer polypropylene. As described in U.S. Patent Application Publication No. 2009/0211847, hub 120 includes a peripheral or perimeter member 124 which forms the outer surface or perimeter of hub 120. Lifeline 40 is coiled around peripheral or perimeter member 124 which facilitates smooth coiling and uncoiling of lifeline 40 therearound when lifeline 40 extends and retracts during normal, non-locked use. As also described U.S. Patent Application Publication No. 2009/0211847, hub 120 also included an intermediate connector such as a septum 126 extending between peripheral member 124 and a radially inward or generally central portion 128 of hub 120. The thickness and/or other properties of septum 126 enable adjusting or determining the energy absorption afforded by hub 120 using defined engineering principles as described in U.S. Patent Application Publication No. 2009/0211847.

In the case of a fall, at the instant that drum assembly 100 has locked and tension in lifeline 40 is rapidly increasing, coils of lifeline 40 constrict around hub 120. At a certain tension level, determined, for example, in large part by the thickness of septum 126, hub 120 will begin to crush as a result of the radial forces acting upon it. Deformation of hub 120 absorbs energy. Generally central portion or flange connecting portion 128 of hub 120 (around passage 123) remains substantially or completely undeformed to facilitate rotation of hub or drum assembly 100 after energy absorbing deformation of at least a portion of hub 120.

Retracting lifeline system 10 further includes a shock or energy absorbing system 800 to further absorb energy in the case of a fall. In many cases, lifelines of retracting lifeline system include an energy absorbing system at a distal end of the lifeline thereof. However, because lifeline 40 is used in tie-back applications, an energy absorbing system positioned at the distal end thereof can become isolated from the remainder of system 10 upon tie-back and thus become inoperative to absorb energy.

Energy absorbing system 800 is in operative connection with housing 20. In a number of embodiments, energy absorbing system 800 includes, for example, at least one element which effectively lengthens (for example, via deformation, breakage, tearing etc.) while absorbing energy during a fall by the user of retracting lifeline system 10. In the illustrated embodiment (see, for example, FIGS. 3A through 3C), energy absorbing system 800 includes a section or sections of webbing 810 that is/are woven, sewn or stitched together (see FIG. 3B) as known in the fall protection arts. In the case of a fall, weaving or stitching 812 (see FIG. 3B) of webbing 810 breaks or tears to absorb energy as webbing 810 effectively lengthens to an extended state as illustrated in FIG. 3C.

In the illustrated embodiment, extending, energy absorbing section or webbing 810 is connected to (or forms a part of) a first retaining member or bracket 820, which is in operative connection with and provides a base for connector 30, and to a second retaining member or bracket 840 which is connected to (or forms a part of), for example, frame 50 to be operatively connected to hub assembly 100 and lifeline 40. In the illustrated embodiment, webbing 810 is formed in a loop which extends around a first shaft 822 connected to first retaining member 820 and around a second shaft 842 connected to second retaining member 820 (see, for example, FIGS. 3E and 3F).

As, for example, illustrated in FIG. 4, first retaining member 820 can, for example, be formed as a generally U-shaped bracket, which can, for example, be formed monolithically from a single piece or length of metal such as stainless steel. First shaft 822 passes through holes or passages 824 formed in extending members 826 to connect to first retaining member 820. Second retaining member 840 includes spaced extending members 884, which extend from frame 50. Frame 50 and extending members 824 can, for example, be formed monolithically from a single piece or length of metal (for example, stainless steel). Second shaft 842 passes through holes or passages 846 formed in extending members 844.

In the illustrated embodiment, first retaining member 820 and second retaining member 840 are connected or attached in a manner to provide a load indicator. That is, an observable change, associated with disconnection of first retaining member 820 from second retaining member 840 and relevant movement thereof, occurs when retracting lifeline system 10 experiences a first load, which can be less than or equal to a second load experienced in a fall situation, but is nonetheless of sufficient magnitude that retracting lifeline system 10 should undergo at least a thorough inspection. In the illustrated embodiment, extending members 826 of first retaining member 820 are spaced slightly wider than extending members 844 of second retaining member 840 to extend therearound. Extending members 826 include holes or passages 828 which are aligned with holes or passages 848 formed in extending members 844 so that shear pins 850 or other breakable or disconnectible connectors can be passed therethrough to connect extending members 826 with extending members 844. In the illustrated embodiment, two shear pins 850 are illustrated. However, a single shear pin which extends to pass through passages 828 and passages 848 on both sides of first retaining member 820 and second retaining member 840 can be used.

During use of retracting lanyard system 10, forces on lifeline 40 are passed via drum assembly 100, shaft 70 and frame 50 to pins 850. Under a load of a magnitude of the first load described above, pins 850 will shear, and first retaining member 820 will separate from second retaining member 840. First load can, for example, be in the range of approximately 450 to approximately 650 lbs. In a number of embodiments, first load was approximately 600 lbs. The load indicator can, for example, actuate under a load of sufficient magnitude that damage to system 10 can occur (such that system 10 should be taken out of surface for at least inspection). However, the magnitude of value of the first load should not be so low that the load indicator activates under normal loads experienced in normal use. The state of activation of the load indicator after system 10 experiences the first load is illustrated in FIGS. 2B and 3B. First retaining member 820 is connected to a housing section 26 that separates from the remainder of housing 20 (which otherwise remains intact) in the state of FIGS. 2B and 3B. Even if the load is not of sufficient magnitude that weaving or stitching 812 in webbing 810 tears, first retaining member 820 and second retaining member 840 will separate by a distance defined by the length of the loop of webbing 810 as shortened by weaving or stitching 812. The separation and corresponding change in appearance of system 10 provides a clear indication that a load equal to or exceeding the first load has been experienced.

Each housing section 20*a* of housing 20 can, for example, be formed (for example, molded) monolithically from a polymeric material such as a high-impact nylon. Housing section 26 can, for example, be formed (for example, molded) from the same or similar polymeric material as housing section 20*a* of housing 20 and can, for example, for a snap fit with housing sections 20*a* when assembled. In general, the load indicator operates independently of housing 20. Although housing section 26 separates with retaining member 820 upon the occurrence of the first load, the magnitude of the first load is determined by pins 850 in connection with first retaining member 820 and second retaining member 840. In that regard, loads required to deform and/or break polymeric materials are typically too low or too unpredictable. Use of breaking or shearing members such as metallic shear pins 850 provides substantial control over and tuning of the load required to activate the load indicator.

After breaking of shear pins 850, weaving or stitching 812 can tear, absorbing energy, and the loop of webbing 810 will expand or extend to the state illustrated in FIGS. 2C and 3C. In a number of embodiments, energy absorbing system 800 was designed so that force in lifeline 40 did not exceed 900 pounds in a fall. FIG. 3G provides a plot of force in lifeline 40 (that is, the force experienced by an end user) over time in a fall study. As seen in FIG. 3G, when the force reaches approximately 600 pounds at point x, shear pins 850 break and the force drops to approximately 0. As force rapidly increases, weaving or stitching 812 of energy absorbing system 800 begins to tear and the force is maintained less than 900 pounds over a region y as energy absorbing system 800 absorbs a portion of the energy of the fall.

As second loop of a webbing 816 or other material (having an ultimate load greater than webbing 810) can also extend around shafts 822 and 842 to ensure that connector 30 remains connected to frame 50 and lifeline 40. Webbing 815 can, for example, have an ultimate tensile load of at least 4500 pound or at least 5000 pounds. Other types of energy absorbing systems in which, for example, a length of a material such as a metal is uncoiled and/or torn (see, for example, U.S. Patent Publication No. 2009/1094366) or one or more friction elements is/are pulled through a constriction can be used.

First retaining member 820 includes a passage 830 in an upper (in the orientation of FIG. 4) section thereof which spans between extending members 826. A post or pivot member 860 of connector 30 passes through passage 830 and through a passage 27 formed in housing section 26 to connect to clevis loop or clevis 31 of connector 30 via a connecting member 862 which passes through passages 32 formed in clevis 31 of connector 30 and a passage 864 formed in post member 860 to connect clevis 31 to post member 860. Pivot member 860 is rotatable within passages 830 and 27 to provide rotation of retracting lanyard system 10 about and axis A as illustrated, for example, in FIG. 5A. Washers or bushings 832 and 34 can be provided to facilitate rotation of pivot member 860. Clevis 31 is pivotably connected to post or pivot member 860 via connecting member, pin or shaft 862 to provide for rotation or pivoting of housing 20 relative to clevis 31 about axis A1 as illustrated in FIG. 5A and described further below.

Figure 3A:
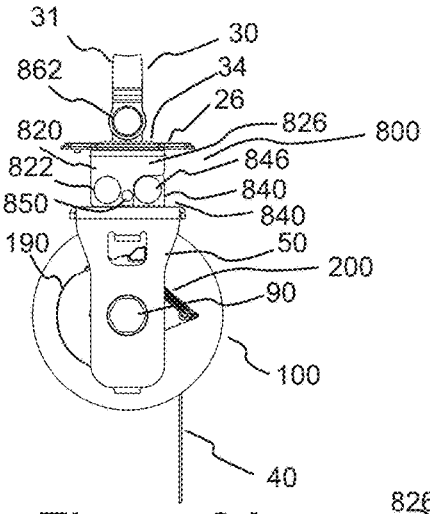
FIG. 3A illustrates a front view of the retractable lifeline system of FIG. 1A wherein the housing has been removed.
Figure 3B:
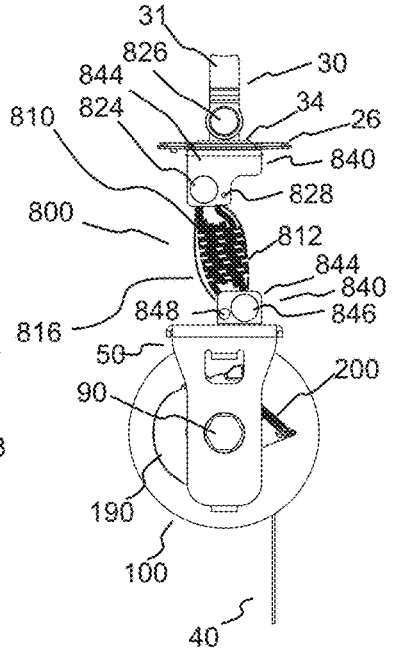
FIG. 3B illustrates a front view of the retractable lifeline system of FIG. 1A wherein the housing has been removed and wherein the load indicator has been activated in the case of a fall.
Figure 3C:
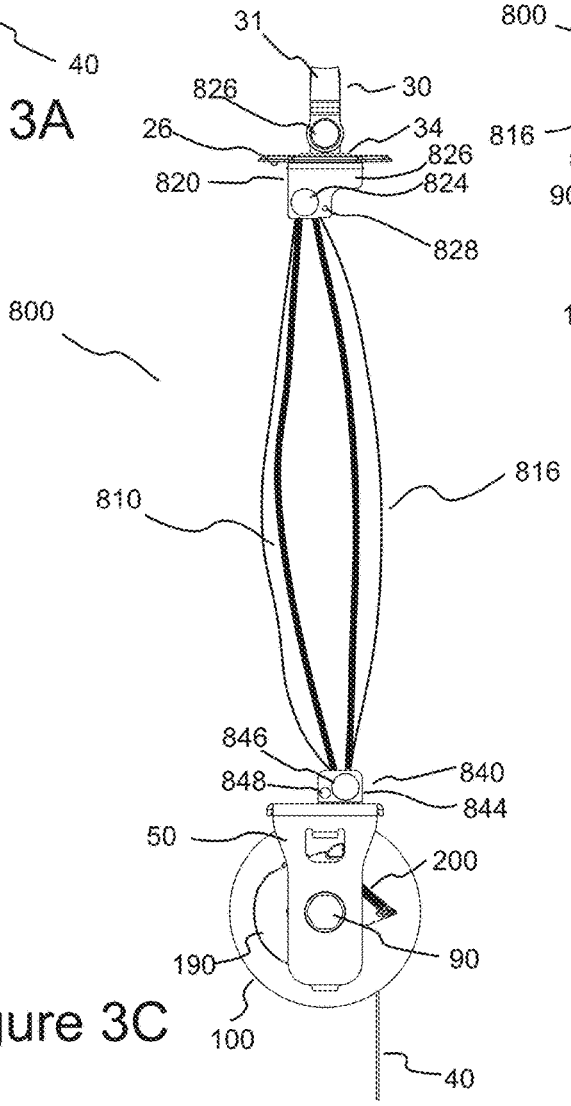
FIG. 3C illustrates a front view of the retractable lifeline system of FIG. 1A wherein the housing has been removed and wherein the energy absorbing system has been activated.

A spacer 868 (for example, a polymeric annular member) can be provided at the lower (in the orientation of FIG. 4) end to space rotating pivot member 860 from webbing 812 and/or webbing 816 during normal operation of retracting lifeline system 10 (that is, in the state illustrated in FIGS. 2A and 3A, in which the load indicator has not been activated). In that regard, rotation of pivot member 860 can eventually cause wear or damage of such webbing if pivot member 860 were in contact therewith.

Figure 3D:
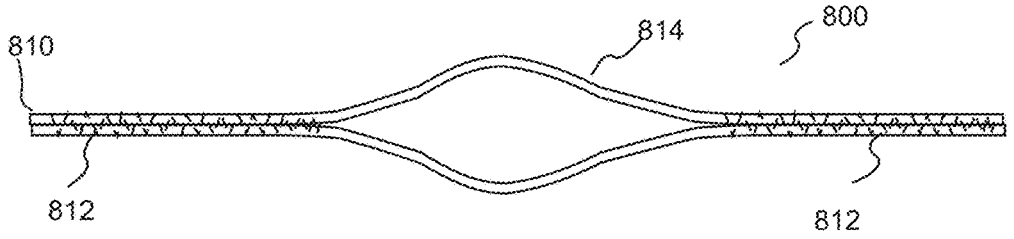
FIG. 3D illustrates an example of an energy absorbing system used in FIG. 1A.
Figure 3E:
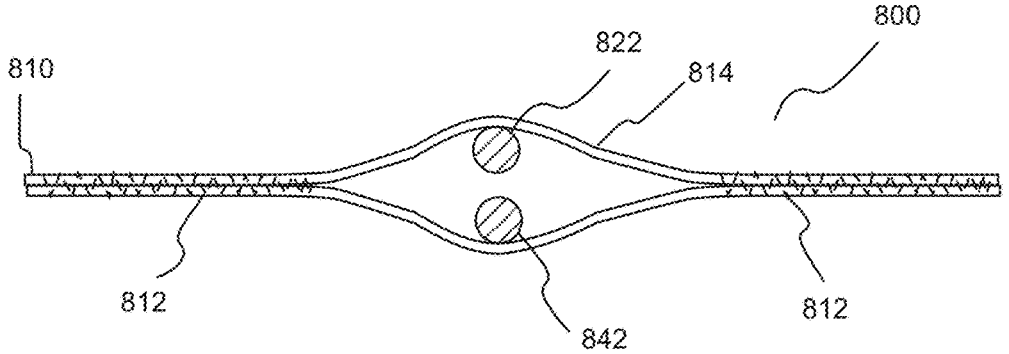
FIG. 3E illustrates an embodiment of an energy absorbing system used in the retractable lifeline system of FIG. 1A in connection with connecting shafts.
Figure 3F:
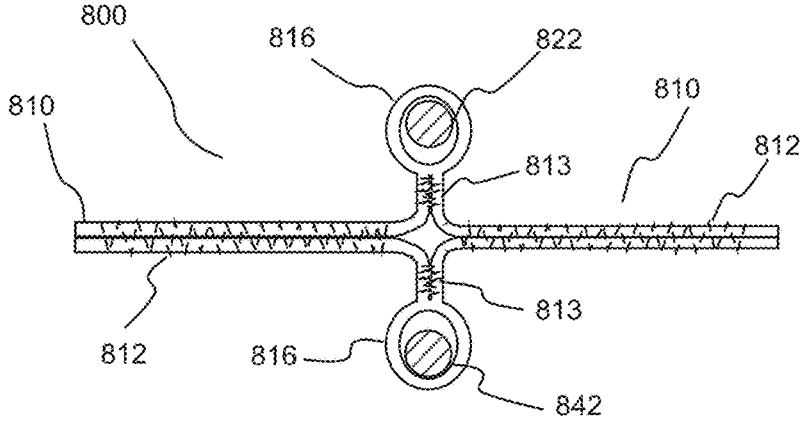
FIG. 3F illustrates an embodiment of an energy absorbing system used in the retractable lifeline system of FIG. 1A subsequent to forming individual loops for each of the connecting shafts.
Figure 3G:
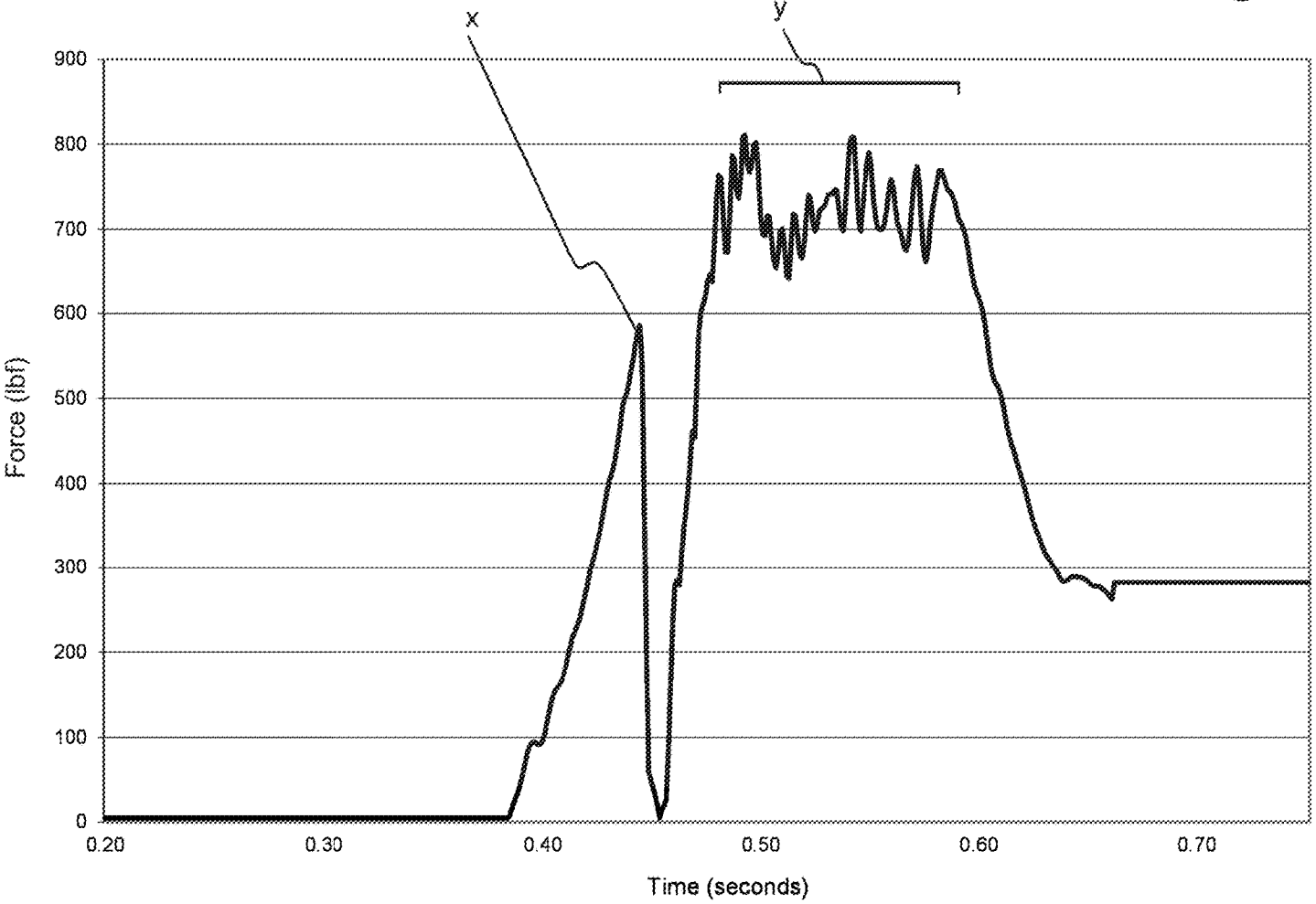
FIG. 3G illustrates a plot of force versus time in a fall study of a retractable lifeline system hereof.

As illustrated in FIGS. 3D through 3F (in which a portion of energy absorbing system 800 is illustrated), in a number embodiments, two sections of a tear webbing 810 were connected with tear element 812, leaving an intermediate open, or unconnected section 814. In a number of embodiments, natural polyester tear web available from Sturges Manufacturing Company, Inc. of Utica, N.Y., Unites States of America was used in which open section 814 was approximately 2.7 inches in length and the stitched or woven sections on each side thereof were approximately 4.25 inches in length. See U.S. Patent Application Publication 2008/0179136. In a number of studies, section 814 was looped around first shaft 822 and second shaft 842 as illustrated in FIG. 3E. It was discovered, however, that such an arrangement could result in incorrect operation of energy absorbing system 800. In that regard, only one side of tear elements 812 might tear or disconnect at one time, resulting in insufficient energy absorption in the case of a load associated with a fall. It was discovered that if intermediate section were sewn with stitching 813 to form two loops 816 (as illustrated in FIG. 3F) in which first shaft 822 and second shaft 842 were placed, even tearing of each side of tear elements 812 would result in the case of a load associated with a fall. Stitching (or other connections) 813 remains intact through a fall as, for example, there is little or no load on stitching 813 to cause it to tear.

The operative connection of connector 30 with first retaining member 820 facilitates the attachment of one or more retracting lifeline systems into the support systems disclosed in U.S. Patent Application Publication No. 2009/0211849. FIGS. 5A through 7B illustrates an embodiment a support system 210 for placing multiple retracting lifeline systems 10 (and/or other devices/systems) in operative association with a person. Support system 210 and similar systems are, for example, described in U.S. Patent Application Publication No. 2009/0211849. In the illustrated embodiment, two retracting lifeline systems 10 are attachable to support system 210. As described in U.S. Patent Application Publication No. 2009/0211849, support system 210 includes a connector 214 including, for example, a rigid member such as a frame 220 (for example, formed from a metal such as stainless steel) and an extending member such as a pin or other element 240 which can be placed in removable or selective operative connection D ring 410 of harness 400 (see, for example, FIGS. 7A and 7B). In the illustrated embodiment, pin 240 is movably or slidably positioned between a front frame member 220*a* and a rear frame member 220*b* of frame 220.

Frame 220 further includes a space or slot 222 formed in an upper surface 220*c* thereof, which is in communicative connection with the space between front frame member 220*a* and rear frame member 220*b*. As illustrated, for example, in FIGS. 5A and 5B, D ring 410 can be inserted within slot 222. As illustrated, for example, in FIG. 5F, pin 240 can be passed through the opening in D ring 410 to retain connector 214 in operative connection with D ring 410.

In several embodiments, at least two independent actions are required of a user to remove connector 214 from operative connection with D ring 410. In the illustrated embodiment, one must first rotate an abutment element or catch lever 260 about a pivot element 262 (for example, a rivet) to remove catch lever 260 from abutting contact with a forward end of an attachment element such as a pin, shaft or rod 240. Abutment element 260 can, for example, be rotated approximately 45 degrees to move it out of abutment with attachment element or pin 240 and to allow clearance for attachment pin 240 to slide, move or retract within the space between front frame member 220*a* and rear frame member 220*b* of frame 220. In the illustrated embodiment, attachment pin 240 is movably or slidably retained within a passage or hole 224 formed in forward frame member 220*a* of frame 220. Contact elements such as pins 226 (positioned within passages 228 formed in front frame member 220*a*) extend into passage 224 to cooperate with slots 244 formed along a portion of the length of attachment pin 240. Cooperation of pins 226 with slots 244 prevents attachment pin 240 from being removed from operative connection with frame member 240 and prevents rotation of attachment pin 240 relative to (and between) front frame member 220*a* and rear frame member 220*b*, while allowing attachment pin 240 to slide between front frame member 220*a* and rear frame member 220*b*.

In the illustrated embodiment, attachment pin 240 is formed generally as a cylinder having a generally central passage 246. The inner wall of passage 246 includes threading (not shown) over at least a portion thereof to form a threaded engagement with threading 248 of a rod, shaft or bolt 250. Bolt 250 passes through a passage or hole 230 formed in front frame member 220*a* to enter the space between front frame member 220*a* and rear frame member

220*b* and engage attachment pin 240. A grasping member, such as a knurled knob 252, can be provided to facilitate grasping and rotation of bolt 250. In that regard, after moving catch lever 260 out of contact with attachment pin 240, knob 252 is rotated (for example, counterclockwise) until threading 248 of bolt 250 disengages cooperating threading of attachment pin 240 and attachment pin 240 is free to move independently of bolt 250. At this point, attachment pin 240 can be slid forward (for example, under the force of gravity upon tilting of connector 214) until it is suitably clear of connection with D Ring 410 so that D ring 410 can be removed from slot 222.

The process described above for removal of D ring 410 is reversed to connect D ring 410 to connector 214. In that regard, D-Ring 410 in inserted into slot 222 until D-Ring moves past or clear of attachment pin 240. Attachment pin 240 is then slid rearward to pass through the center hole in D-Ring 410. While holding attachment pin 240 to both maintain its position through the center hole of D-Ring 410 and abut bolt 250, knob 252 is rotated (for example, clockwise) so that threading 248 engages the threading in passage 246 of attachment pin 240. Upon hand tightening, attachment pin 240 is fully engaged. After engaging attachment pin 240, catch lever 260 is rotated into engagement with attachment pin 240. In several embodiments, the distal end of catch lever 260 includes a U shaped bracket 264 that contact frame 220 to provide an indication to the user that catch lever 260 is in the engaged position. Bracket 264 can be dimensioned so that the legs thereof must be forced outward to engage frame 220, thereby reducing the likelihood that catch lever will be accidentally disengaged from abutting contact with attachment pin 240. A detent element 266 can also be provided to assist in maintaining catch lever in an engaged state. Once catch lever 260 is in abutting contact with attachment pin 240, attachment pin 240 cannot slide forward to a disengaged position.

To attach or remove retracting lifeline systems 10 (and/or other elements such as safety devices) to connector 214 in the embodiment illustrated in FIGS. 5A through 7B, one first rotates catch lever 260 to allow clearance for attachment pin 240 to retract as described above. Knob 252 is then rotated until attachment pin 240 is disengaged from and free to move independently of bolt or shaft 250. Attachment pin 240 is then slid forward until generally clear of slot 222.

Connector 214 further includes a retainer such as a sliding retainer or bracket 270 that is slidably positioned on frame 220. In the illustrated embodiment, bracket 270 is generally U shaped including a front member 270*a* and a rear member 270*b* connected over a central portion thereof by a lower member 270*c*. Bracket 270 further includes tabs 272 extending from the top of front member 270*a* and rear member 270*b* thereof to at least partially encompass frame 220. Tabs 272 can include downward extending sections 272*a* that form a detent engagement with seatings or passages to assist in maintaining bracket 270 in a first or detent position as further described below. During assembly, shaft or bolt 250 passes through a passage 274 formed in rear surface 270*b* of bracket 270 before knob 252 is attached thereto. The attachment of shaft or bolt 250 and knob 252 assists in retaining bracket 270 in operative connection with frame 220. As, for example, illustrated in FIG. 5H, passage 230 is elongated so that knob 252, bolt 250 and bracket 270 can be slid relative to frame member 240 over a range of positions (as described further below) limited by the width of passage 230.

Figure 6A:
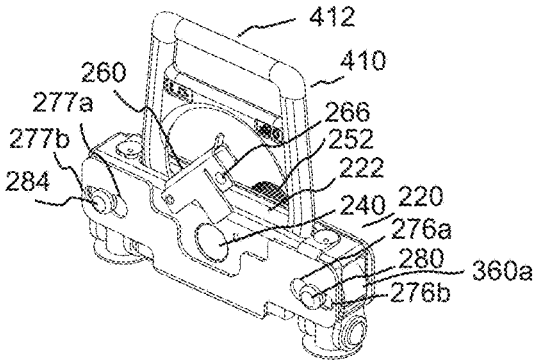
FIG. 6A illustrates the a front perspective view of the connector of the system of FIG. 5A wherein a retainer or an abutment member has been rotated out of abutment with an attachment member of the connector.
Figure 6B:
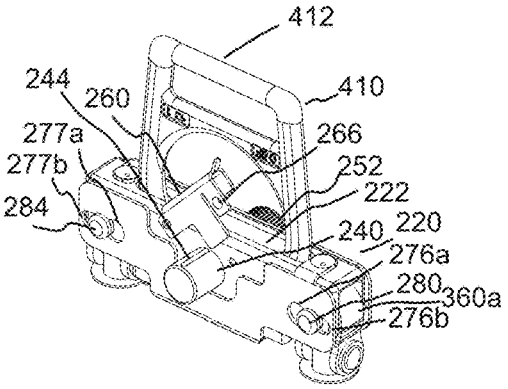
FIG. 6B illustrates a front perspective view of the connector illustrating rotation of a cooperating attachment member so that a threaded portion of the cooperating attachment member moves out of operative connection with the D ring so that the connector can be removed from connection with the D ring.
Figure 6C:
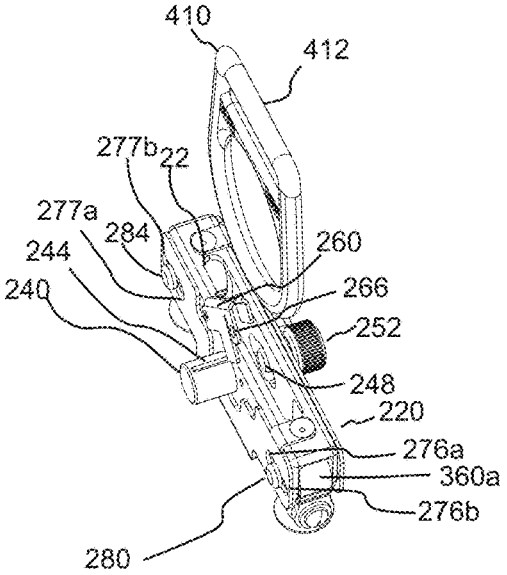
FIG. 6C illustrates a front perspective view of the connector wherein the connector has been disconnected from the D ring.
Figure 6D:
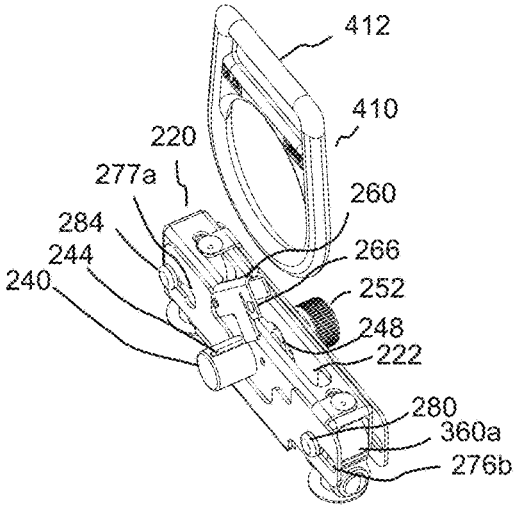
FIG. 6D illustrates a front perspective view of the connector wherein a sliding retainer bracket has been slid to a first side to allow removal of a first attachment or retaining pin and removal of a first retracting lifeline system from connection with the connector.

Once attachment pin 240 is disengaged form bolt 250 and slid forward to be generally clear of slot 222 (and out of engagement with passage 230 of retainer bracket 270) as described above, bracket 270 can be slid to one side out of the first, detent position and to a second position (for example, to the right as illustrated in FIG. 6D). In that regard, bracket 270 is slid to the right (in the illustrated orientation) until a first device attachment pin or rod 280 is clear to be removed through relatively larger openings 276*a* formed in front surface or members 270*a* and 270*b* of sliding bracket 270. In that regard, openings 276*a* are in communicative connection with slots 276*b* that have a width that is smaller than the width of openings 276*a*. When bracket 270 is in the first or detent position (as, for example, illustrated in FIG. 6C), slots 276*b* of front member 270*a* and rear member 270*b* engage areas of reduce diameter or seatings 282 formed in device attachment pin 280 to retain device attachment pin 280 in operative connection with bracket 270 and frame 220 (via passages 234). Likewise, when bracket 270 is in the first or detent position, slots 277*b* of front member 270*a* and rear member 270*b* engage areas of reduce diameter or seatings 286 formed in a second device attachment pin 284 to retain device attachment pin 284 in operative connection with bracket 270 and frame 220 (via passages 236).

Figure 6E:
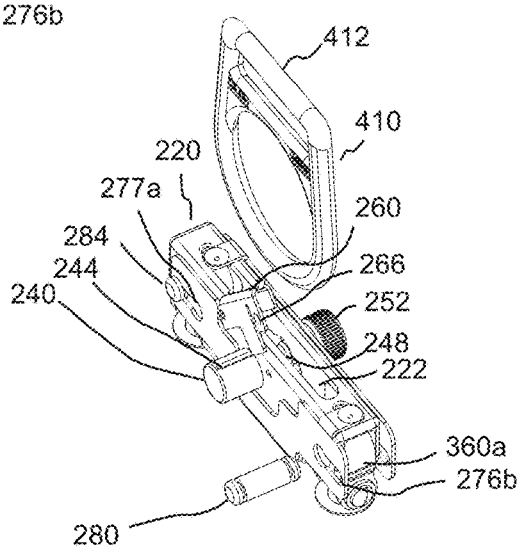
FIG. 6E illustrates a front perspective view of the connector and removal of the first retaining pin.

Once bracket 270 is slid to the second position illustrated in FIG. 6D, device attachment pin 280 can be removed and set aside as illustrated in FIG. 6E. At this point, device attachment bushing 288 is placed into retracting lifeline clevis 31 (see, FIGS. 4 and 5F) until generally flush. While maintaining attachment bushing 288 within clevis 31, attachment bushing 288 is slid into the space between front frame member 220*a* and rear frame member 220*b* of frame 220 and align passages 276*a* and passages 234. Device attachment pin 280 is passed through passages 276*a*, passages 234 and through a central passage or hole in attachment bushing 288. Once device attachment pin 280 is so engaged and protrudes generally equally to the front and to the rear of rigid member 220, device attachment bracket 270 can be slid to it's first, neutral or detent position, thereby engaging both seatings 282 of device attachment pin 280 with keyhole slots 276*b* to capture device attachment pin 276*b*.

Figure 6F:
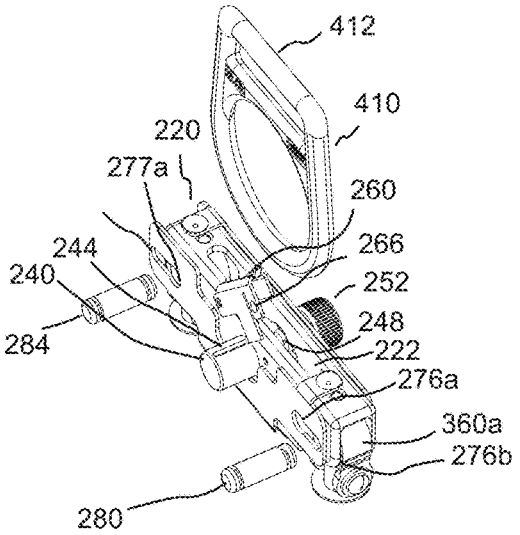
FIG. 6F illustrates a front perspective view of the connector wherein the sliding retainer bracket has been slid to the second side and the second retaining pin has been removed to allow removal of a second retracting lifeline system from connection with the connector.

To attach another retracting lifeline system 10 (or other elements) to connector 214, the above process is repeated, but device attachment or retainer bracket 270 is slid in the opposite direction (that is, to the left) to a third position as illustrated in FIG. 6F to first enable removal of a second device attachment pin 284 through passages 277*a* and passages 234. After attaching a second retracting lifeline system 10 via pin 284, bracket 270 is slid to the first, neutral or detent position so that keyhole slots 277*b* engage seatings 286 in device attachment pin 284. At this point, attachment pin 240 can be engaged with bolt or shaft 250 as described above, and catch lever 260 can be place in abutting engagement with attachment pin 240.

Figure 7A:
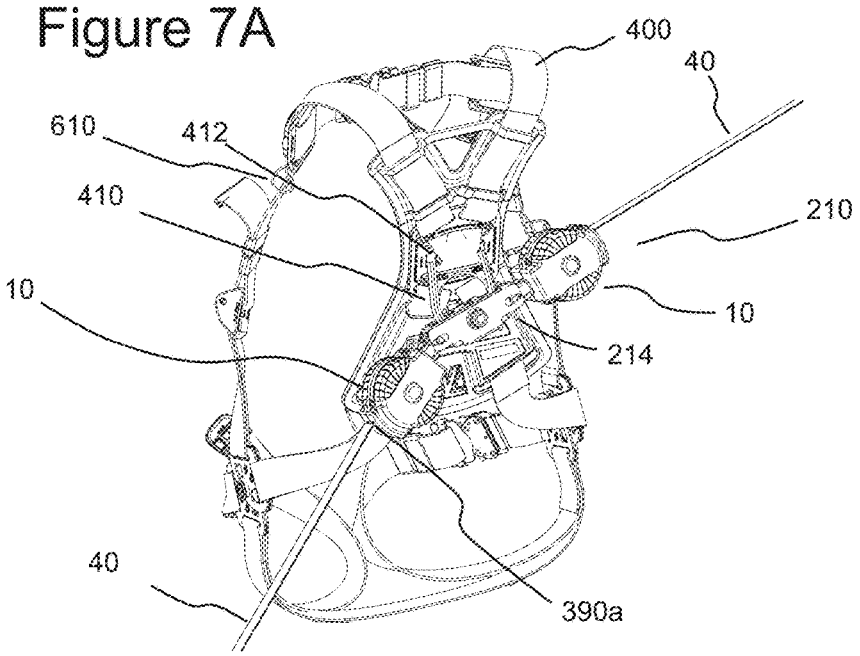
FIG. 7A illustrates a perspective view the system of FIG. 5A attached to a harness D ring, and illustrates the freedom of motion of each of the retracting lifeline systems attached to the connector of the system.
Figure 7B:
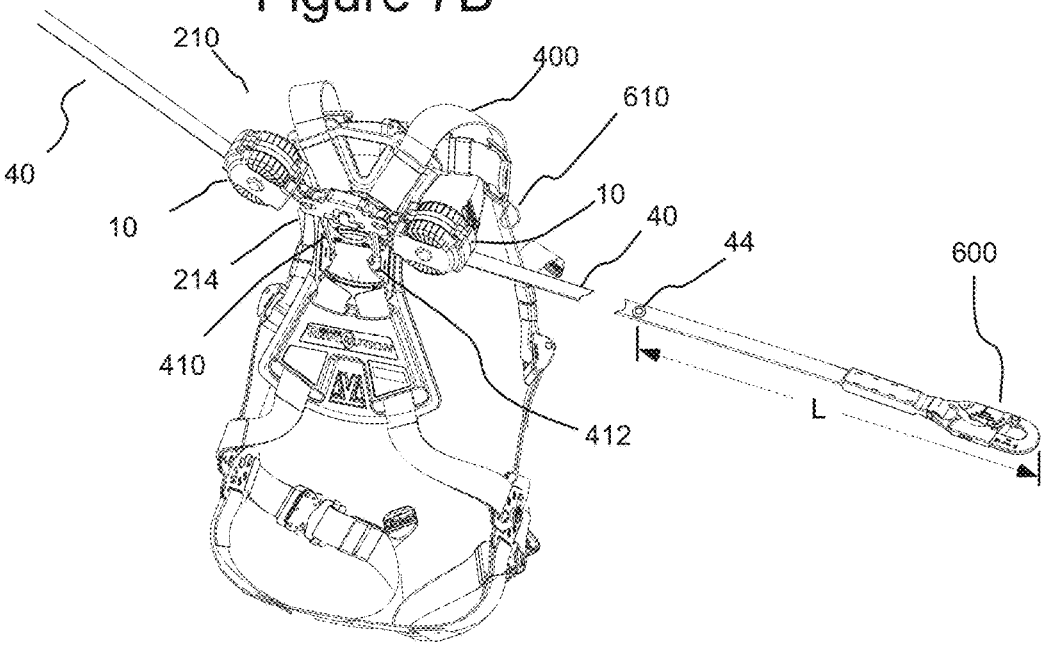
FIG. 7B illustrates another perspective view the system of FIG. 5A attached to a harness D ring, and further illustrates the freedom of motion of each of the retracting lifeline systems attached to the connector of the system.

FIGS. 7A and 7B are indicative of the range of motion provided by system 210, which is substantially greater than the range of motion provide by systems 10. As described above, in the embodiment of FIGS. 5A through 7B, connector 214 attaches to, for example, back D-Ring 410 of harness 400 via single attachment pin 240. In the illustrated embodiment, connector 214 allows each attached device (retracing lifeline system 10 in the illustrated embodiment) to rotate approximately 90 degrees about axes A2 (see FIG. 5A) as defined by attachment pins 280 and 284. Inherent to connectors 30 of retracting lifeline system 10, housing 20 of each retracting lifeline system 10 is able to pivot approximately 150 degrees about axes A1 (that is, about connector, shaft or pin 862 and relative to connector 30 and to frame 220) and rotate 360 degrees about longitudinal axes A (relative to connector 30 and to frame 220) (see FIG. 5A). As, for example, represented by arrows F in FIG. 5A and illustrated in FIG. 7A, the connection between connector 214 and the harness D Ring 410 in one embodiment allows approximately 30 degrees of motion (rotation of connector 214, generally about pin 240, in the plane defined by D ring 410), for example, aid in alignment with anchor point(s). More or less rotation about D ring 410 can be provided. Furthermore, as represented by arrows D in FIG. 5A, inherent to the motion of D-Ring 410 relative to harness 400, D-Ring 410 and system 210 are able to rotate (generally about an axis defined by transverse member 412 as illustrated in FIG. 5A) approximately 150 degrees relative to harness 400 (compare FIGS. 7A and 7B).

As illustrated, for example, in FIGS. 7A and 7B, the freedom of motion of retracting lifeline systems 10 relative to connector 214/frame 220 (as well as the freedom of movement of D ring 410 and connector 214 relative to safety harness 400), allow housings 20 to be free to move (independently) toward or into alignment with the orientations their respective lifelines 40, which exits housings 20 at exit 22 formed in housings 20 (see, for example, FIG. 2G). Bends in lifelines 40 at exits 22 of housings 20, which can detrimentally make extension of lifeline 40 difficult, hinder automatic retraction of lifeline 40 and allow extra slack in lifeline 40, can be minimized or avoided.

In the embodiments set forth above, lateral pivoting of retracting lifeline systems 10 occurs about the axes of extending members or attachment pins 280 and 284. As clear to one skilled in the art, however, lateral pivoting or rotation of the retracting lifeline housing can be provided by or inherent in a connector of the retracting lifeline system (similar to the rotation provided about axes A1 and A), and such a connector can be fixed or immovably attached to a connector similar to connector 214.

By encompassing a portion of D ring 410 within connector 214, the fall clearance is reduced as compared to, for example, embodiments in which such a connector is attached to a D ring via an intervening connector or attachment element. The vertical (in, for example, the orientation of FIG. 5F) position of attachment pin 240 relative to device attachment pins 280 and 284 determines the distance which retracting lifeline system 10 will be spaced from harness 400 and the person wearing harness 400. As illustrated in, for example, FIG. 5F device attachment pins 280 and 284 are generally vertically aligned with attachment pin 240, resulting in retracting lifeline system 10 being spaced a distance from harness 400 which is less than a resulting spacing distance if a retracting lifeline system 10 and had been connected to D ring 410 via an intervening connector such as a snap hook as is common in the art. Device attachment pins 280 and 284 can, for example, be positioned on frame 240 equidistant from attachment pin 244 to provide balance.

Uninterrupted tie off (where by a tie-back operation or otherwise) is provided with a wide range of movement for a worker either using both retracting lifeline system 10 during a transition from one anchor point to another, or when using a single retracting lifeline or retracting lifeline system with a single anchor point. Although a wide range of motion is provided, the two devices (for example, retracting lifeline system 10) attached to connector 214 are kept separate and are somewhat restricted in their interaction to reduce the possibility of interference. In that regard, retracing lifeline systems 10 can, for example, be prevented from pivoting toward each other (about attachment pins 280 and 284) by an abutment of frame 220 with retracting lifeline system connector 30.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

The invention claimed is:

1. A retracting lifeline system, comprising:

a housing;

a first connector attached to the housing, a lifeline;

a hub to which the lifeline is attached at a first end of the lifeline and around which the lifeline is coiled within the housing, the housing comprising an opening through which the lifeline exits the housing, the hub being tensioned to rotate in a first direction to cause retracting of the lifeline and coiling of the lifeline around the hub; and a second connector attached to a second end of the lifeline;

wherein at least a section of the lifeline has an initial ultimate tensile load of at least 8000 pounds and is abrasion resistant such that the section of the lifeline is available for tie-back anchoring using the second connector, the section of the lifeline being at least partially retractable within the housing;

a stop connected to the lifeline to abut the opening upon retraction of the lifeline, the stop comprising a first member extending from a first surface of the lifeline, and a second member extending from a second surface of the lifeline, wherein the first member has a perimeter having a lower thickness than a radially inward portion of the first member, the second member has a perimeter having a lower thickness than a radially inward portion of the second member, the first member is connected to the second member by a rivet passing through the lifeline, and the first member and the second member have a frustoconical shape to enable easy sliding of the stop over an anchorage structure during tie-back applications; and an energy absorbing system at least partially within the housing, the energy absorbing system comprising a first retaining member and a second retaining member, the first retaining member being connected to a connector extending from the housing so that the connector extending from the housing is rotatable relative to the first retaining member, the connector extending from the housing being connected to the first connector, the second retaining member being operatively connected to the hub, the first retaining member being connected to the second retaining member by at least one energy absorbing member that increases in effective length upon activation thereof so that the distance between the first retaining member and the second retaining member increases upon activation of the energy absorbing system.

2. The retractable lifeline system of claim 1, wherein the lifeline comprises a webbing.

3. The retractable lifeline system of claim 2, wherein, webbing lifeline is woven from at least two fiber materials to include an interior of a high strength or high tenacity fiber material, and an exterior of an abrasion resistant fiber material.

4. The retractable lifeline system of claim 3, wherein, the interior high strength fiber is of a first color, and the exterior abrasion resistant fiber is of a second color to detect damage.

5. The retractable lifeline system of claim 1 wherein the energy absorbing member comprises at least a first length of material connected to a second length of material via tear elements which tear to absorb energy upon activation of the energy absorbing system.

6. The retractable lifeline system of claim 1 further comprising at least one breakable connector connecting the first retaining member to the second retaining member, the breakable connector breaking upon a first load such that first retaining member separates from the second retaining member by an observable distance to provide an observable indication that the first load has been experienced.

7. The retractable lifeline system of claim 6 wherein the energy absorbing member can be activated upon breaking of the breakable connector.

8. The retractable lifeline system of claim 1 wherein activation of the energy absorbing member maintains a load experienced by the lifeline during activation of the energy absorbing member no greater than a predetermined magnitude.

9. A retracting lifeline system, comprising:

a housing;

a first connector attached to the housing, a lifeline;

a hub to which the lifeline is attached at a first end of the lifeline and around which the lifeline is coiled within the housing, the housing comprising an opening through which the lifeline exits the housing, the hub being tensioned to rotate in a first direction to cause retracting of the lifeline and coiling of the lifeline around the hub;

a stop connected to the lifeline to abut the opening upon retraction of the lifeline, the stop comprising a first member extending from a first surface of the lifeline, and a second member extending from a second surface of the lifeline, wherein the first member has a perimeter having a lower thickness than a radially inward portion of the first member, the second member has a perimeter having a lower thickness than a radially inward portion of the second member, the first member is connected to the second member by a rivet passing through the lifeline, and the first member and the second member have a frustoconical shape to enable easy sliding of the stop over an anchorage structure during tie-back applications; and an energy absorbing system positioned at least partially within the housing, the energy absorbing system comprising a first retaining member and a second retaining member, the first retaining member being connected to a connector extending from the housing to connect to the first connector so that the connector extending from the housing is rotatable relative to the first retaining member, the second retaining member being operatively connected to the hub, the first retaining member being connected to the second retaining member by at least one energy absorbing member that increases in effective length upon activation thereof so that the distance between the first retaining member and the second retaining member increases upon activation of the energy absorbing system.

10. The retractable lifeline system of claim 9, wherein the lifeline comprises a webbing.

11. The retractable lifeline system of claim 10, wherein, webbing lifeline is woven from at least two fiber materials to include an interior of a high strength or high tenacity fiber material, and an exterior of an abrasion resistant fiber material.

12. The retractable lifeline system of claim 11, wherein, the interior high strength fiber is of a first color, and the exterior abrasion resistant fiber is of a second color to detect damage.

13. The retractable lifeline system of claim 9 wherein the energy absorbing member comprises at least a first length of material connected to a second length of material via tear elements which tear to absorb energy upon activation of the energy absorbing system.

14. The retractable lifeline system of claim 13 further comprising at least one breakable connector connecting the first retaining member to the second retaining member, the breakable connector breaking upon a first load such that first retaining member separates from the second retaining member by an observable distance to provide an observable indication that the first load has been experienced.

15. The retractable lifeline system of claim 14 wherein in the energy absorbing member can be activated upon breaking of the breakable connector.

16. The retractable lifeline system of claim 15 wherein activation of the energy absorbing member maintains a load experienced by the lifeline during activation of the energy absorbing member no greater than a predetermined magnitude.

* * * * *